US012453882B2

(12) United States Patent
Cutler

(10) Patent No.: US 12,453,882 B2
(45) Date of Patent: Oct. 28, 2025

(54) PLANK STAND

(71) Applicant: Daniel Cutler, Herzliya (IL)

(72) Inventor: Daniel Cutler, Herzliya (IL)

( * ) Notice: Subject to any disclaimer, the term of this patent is extended or adjusted under 35 U.S.C. 154(b) by 46 days.

(21) Appl. No.: 18/703,423

(22) PCT Filed: Oct. 24, 2022

(86) PCT No.: PCT/IB2022/060191

§ 371 (c)(1),
(2) Date: Apr. 22, 2024

(87) PCT Pub. No.: WO2023/073527

PCT Pub. Date: May 4, 2023

(65) Prior Publication Data

US 2024/0342539 A1 Oct. 17, 2024

Related U.S. Application Data

(60) Provisional application No. 63/344,654, filed on May 23, 2022, provisional application No. 63/272,240, filed on Oct. 27, 2021.

(51) Int. Cl.
*A63B 21/068* (2006.01)
*A63B 21/00* (2006.01)

(52) U.S. Cl.
CPC ..... *A63B 21/068* (2013.01); *A63B 21/00047* (2013.01); *A63B 2225/09* (2013.01)

(58) Field of Classification Search
CPC ..... A63B 21/068; A63B 21/00047; A63B 2225/09; A63B 23/0238; A61H 1/0229; A61H 1/0292; A61H 2201/1614; A61H 2203/0487; A61H 2201/0157; A61H 2201/1284; A61H 2201/0192
See application file for complete search history.

(56) References Cited

U.S. PATENT DOCUMENTS 3,477,673 A 11/1969 Bereday
3,936,055 A * 2/1976 Scott ..... A63B 69/3661 473/162
4,629,179 A 12/1986 Bizilia
5,149,174 A * 9/1992 Charash ..... A47C 9/005 297/423.12

(Continued)

FOREIGN PATENT DOCUMENTS

FR 3019019 A1 10/2015
KR 20190042432 A 4/2019

(Continued)

OTHER PUBLICATIONS

International Search Report in PCT/IB2022/060191 dated Dec. 15, 2022.

(Continued)

*Primary Examiner* — Andrew M Kobylarz
(74) *Attorney, Agent, or Firm* — Manelli Selter PLLC; Edward Stemberger

(57) ABSTRACT

A plank stand, comprising: a base; a first leg shaft connected, on a first end thereof, with the base; and at least one first leg support connected with a second end of the first leg shaft; wherein the plank stand is configured to enable a user to stand on the base and lean on the at least one first leg support.

18 Claims, 41 Drawing Sheets

(56) References Cited

U.S. PATENT DOCUMENTS

| | | | | |
|---|---|---|---|---|
| 5,935,050 | A * | 8/1999 | Shahan | A63B 21/4015 482/145 |
| 6,692,418 | B2 * | 2/2004 | Shahan | A63B 23/0233 482/148 |
| 7,128,701 | B1 * | 10/2006 | Ketcham | A63B 23/1254 482/148 |
| 7,297,091 | B2 * | 11/2007 | Nushart | A61H 1/0266 482/79 |
| 8,282,533 | B1 * | 10/2012 | Ferraro | A63B 5/16 280/14.22 |
| 9,630,055 | B2 * | 4/2017 | Runyan | A63B 21/00047 |
| 9,844,271 | B2 * | 12/2017 | Zager | A47C 9/025 |
| 10,118,069 | B2 * | 11/2018 | Grossman | A63B 21/00047 |
| 11,077,338 | B1 * | 8/2021 | Levin | A63B 21/4034 |
| 11,504,577 | B2 * | 11/2022 | Mosher | A61H 1/0229 |
| 11,883,715 | B1 * | 1/2024 | Howard | A63B 21/4037 |
| 2007/0007400 | A1 | 1/2007 | James | |
| 2007/0289599 | A1 | 12/2007 | Klemm et al. | |
| 2009/0305206 | A1 * | 12/2009 | Lipetz | A63B 69/0022 434/247 |
| 2010/0204027 | A1 * | 8/2010 | Dauterive | A61F 5/0116 482/145 |
| 2016/0008665 | A1 * | 1/2016 | Littell | A63B 21/068 482/145 |
| 2016/0375334 | A1 * | 12/2016 | Ragen | A63B 69/0073 473/429 |
| 2017/0042334 | A1 | 2/2017 | Mengshoel | |
| 2017/0105530 | A1 | 4/2017 | Sheinkop | |
| 2017/0172331 | A1 * | 6/2017 | Publicover | B32B 7/022 |
| 2018/0303575 | A1 | 10/2018 | Nardo et al. | |

FOREIGN PATENT DOCUMENTS

| | | | |
|---|---|---|---|
| KR | 102071893 | B1 | 2/2020 |
| KR | 20210029646 | A | 3/2021 |

OTHER PUBLICATIONS

International Preliminary Report On Patentabilty in PCT/IB2022/060191 dated Feb. 4, 2024.

* cited by examiner

PLANK STAND

FIELD OF THE INVENTION

The present invention generally relates to the field of exercise and specifically to an exercise "plank stand" enabling to strengthen abdominal/back, leg, and other muscles while standing or sitting.

BACKGROUND

A wide variety of exercise apparatuses have been developed to specifically exercise the abdominal/back muscles of a user. The apparatuses generally require that the user change into appropriate sports attire, go to the gym or concentrate on exercising, adjust a rather cumbersome device, sit upon the device and secure any straps that may be required in order to use the device, before proceeding with a desired exercise routine. Many such devices do not enable the user to comfortably engage in other activities while exercising, such as, for example, working, meeting with another person and the like.

A familiar exercise has become what is known as the "plank", where a person rests his or her entire weight on their toes at one end and on their elbows or forearms at the other. The objective is to maintain the body in a horizontal stationary position. The stress is considerable, and a person may be able to maintain this position for a duration of anything between several seconds to a few minutes.

Therefore, there is a need for an easy and safe to use plank stand enabling the user to engage in a mainly static exercise for long durations, with low stress and effort levels while, at the same time, for the user being able to partake in other activities, such as, typing, texting, reading, watching TV, conversing etc.

The above mentioned plank exercise (and conventional exercise devices that may simulate the plank position) has the weight of the exerciser supported at both ends of the body, i.e. feet and arms (or chest). The plank stand, in contrast, supports the user only at one end of the body—below the knee (and in a more moderate position, below the pelvis), with the user in a cantilever plank position. The advantage of this approach is that even a slight angle of inclination can create a significant physical effect.

SUMMARY

According to an aspect of the present invention there is provided A plank stand, comprising: a base; a first leg shaft connected, on a first end thereof, with the base; and at least one first leg support connected with a second end of the first leg shaft; wherein the plank stand is configured to enable a user to stand on the base and lean on the at least one first leg support.

The first leg shaft may be movably connected, on the first end thereof, with the base.

The first leg shaft may be configured to be fixated in a plurality of angles in respect to the base.

The first leg shaft may be extendable.

The plank stand may further comprise one or two foot supports connected with one of the first leg shaft and the base The plank stand may further comprise one or two heel supports connected with the base.

The one or two heel supports may be configured to be moved towards and away from the first leg shaft.

The one or two heel supports may be configured to be fixated in a plurality of positions in respect to the first leg shaft.

The at least one of the one or two heel supports may comprise a U-shaped member connected with the base via two hinges.

The at least one of the one or two heel supports may comprise at least one extruding element under the U-shaped member configured to keep the U-shaped member elevated.

The at least one first leg support may comprise at least one depression each configured to receive at least one leg of the user.

The base may comprise at least one insert configured to receive at least one foot of a user.

The plank stand may further comprise: a second leg shaft connected, on a first end thereof, with the base; and one of: at least one second leg support and chair, connected with a second end of the second leg shaft.

The plank stand may further comprise one or two foot supports connected with the second leg shaft.

The plank stand may further comprise at least one second leg support connected with the first leg shaft between the first end and the second end thereof.

The at least one second leg support may be connected with the first leg shaft via at least one mechanism allowing at least one of: vertical, horizontal and angular adjustment of the at least one second leg support in respect to the first leg shaft.

The upper side of the base may be one of: at least partially covered with an anti slip material, comprises an anti slip material, comprises a texture, and comprises a pattern.

The base may have a shape of a wedge.

The plank stand may further comprise at least one floor-angle element connected with the base and may be configured to enable adjustment of an angle of the base relative to a surface on which the base is mounted.

The at least one first leg support may comprise two leg supports, one connected to a left side of the leg shaft, and the other to a right side of the leg shaft.

The at least one first leg support may be slidably connected with the second end of the first leg shaft.

The plank stand may further comprise a designated surface, connected with one of: the leg shaft and the base, and configured to serve as one of: a workstation, a table, a computer dock, a cup holder, left dock, and right dock.

The plank stand may further comprise at least one of: an integrated electric power outlet and communication outlet.

The plank stand may further comprise a swivel mechanism connected with the base and configured to enable the base to rotate.

According to another aspect of the present invention, there is provided a plank device, comprising: at least one leg support configured to be connected with an object thereby enabling a user to stand in front of the at least one leg support and lean on the at least one leg support.

The at least one leg support may be configured to be connected with the object via a first connector connected with the at least one leg support and a second connector connected with the object.

The at least one leg support may comprise at least one depression configured to receive the object and be connected with the object by one of: clamping, screwing, and magnet.

The at least one leg support may comprise at least one depression each configured to receive at least one leg of a user.

The plank device may further comprise a base; wherein an upper side of the base may be one of: at least partially covered with an anti slip material, comprises an anti slip material, comprises a texture, and comprises a pattern; and wherein the base may be configured to be placed in front of the at least one leg support.

The plank device may further comprise: a base; and at least one heel support connected with the base; wherein the base may be configured to be placed in front of the at least one leg support.

The at least one heel support may be configured to be moved towards and away from the at least one leg support.

The at least one heel support may be configured to be fixated in a plurality of positions in respect to the at least one leg support.

Each of the at least one heel support may comprise a U-shaped member connected with the base via two hinges.

Each of the at least one heel support may comprise at least one extruding element under the U-shaped member configured to keep the U-shaped member elevated.

The plank device may further comprise: a base comprising at least one insert configured to receive at least one foot of a user; wherein the base may be configured to be placed in front of the at least one leg support.

According to another aspect of the present invention, there is provided a plank device, comprising: a base; a leg shaft connected, on a first end thereof, with the base; one of: a chair and at least one leg support, movably connected with a second end of the leg shaft; and at least one leg support configured to be connected with an object; wherein the plank device is configured to enable a user to one of: rest at least part of his weight on the chair and rest at least part of his weight on the at least one leg support.

The upper side of the base may be one of: at least partially covered with an anti slip material, comprises an anti slip material, comprises a texture, and comprises a pattern.

The leg shaft may be movably connected, on the first end thereof, with the base.

The leg shaft may be configured to be fixated in a plurality of angles in respect to the base.

The leg shaft may be extendable.

The at least one leg support may comprise at least one depression each configured to receive at least one leg of a user.

The base may comprise at least one insert configured to receive at least one foot of a user.

According to another aspect of the present invention, there is provided a leg support configured to be connected to an object.

BRIEF DESCRIPTION OF THE DRAWINGS

For better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments only of the present invention, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
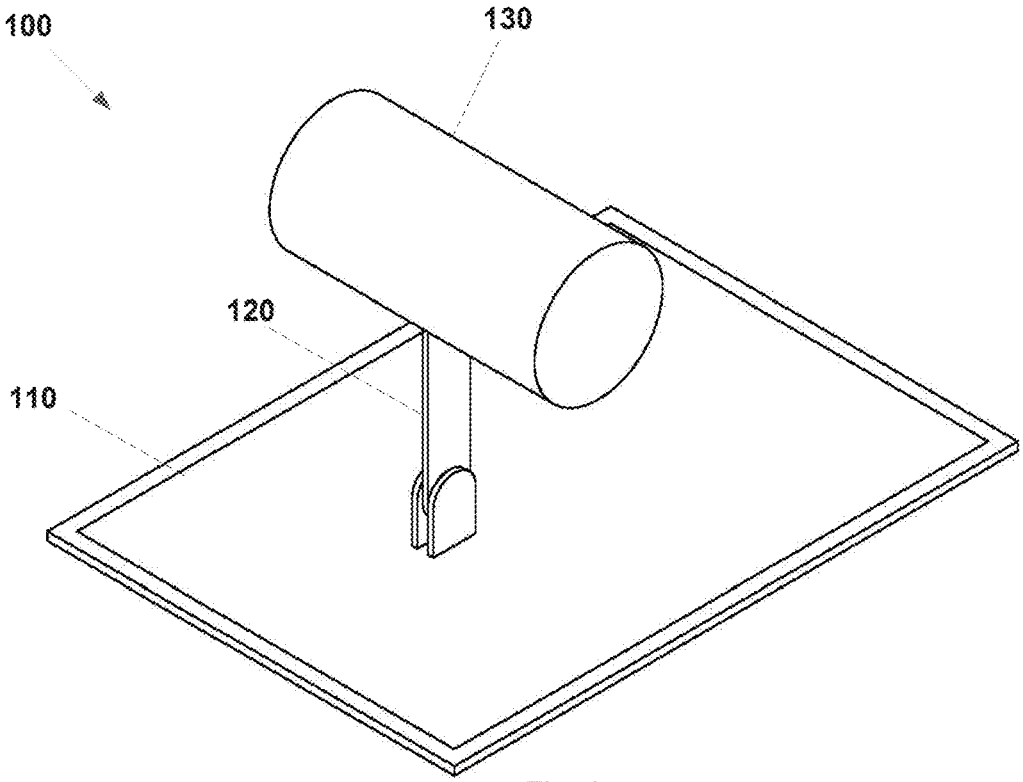
FIG. 1 shows a front perspective view of an exemplary plank stand, according to embodiments of the present invention.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is applicable to other embodiments or of being practiced or carried out in various ways. Also, it is to be understood that the phraseology and terminology employed herein is for the purpose of description and should not be regarded as limiting.

The present invention provides a plank stand which is an abdominal/back and leg muscle exercise device which may also serve as a workstation. The plank stand may include a base, a leg shaft and a leg support. Alternatively, the plank stand may include a base, a leg shaft, a leg support and a heel support. Alternatively, the plank stand may include a base, a leg shaft, a leg support and a foot support. Alternatively, the plank stand may include a base, a leg shaft, a leg support, a heel support and a foot support. Alternatively, the plank stand may include a base, a leg shaft and a chair. Alternatively, the plank stand may include a base, a leg shaft, a leg support and another leg support which may be connected to an object, such as, for example, a table Alternatively, the leg support and leg shaft may be disconnected from the base and the leg support may be connected to another object, such as, for example, a table. Alternatively, a leg support may be connected to an object, such as, for example, a table. In any event, the present invention covers a leg support connected directly to a table even if it has not been disconnected from the Plank Stand.

FIG. 1 shows a front perspective view of an exemplary plank stand 100, according to embodiments of the present invention. The plank stand 100 comprises a base 110, a leg shaft 120, connected with the base 110, and at least one leg support 130 connected with the leg shaft 120 (one is shown).

It will be appreciated that as a user leans forward and rests part of his weight on the leg support 130, there is a counter force that pushes his feet backwards and away from the leg support. Therefore, to prevent the feet from slipping back, according to embodiments of the present invention, the base 110 may be partially or fully covered with or comprise an anti-slip material that has a high coefficient of friction. Examples of anti-slip materials may include, but are not limited to rubber, silicone, plastic, polyester and the like. The anti-slip material is intended to prevent slippage of the user's feet. Alternatively, according to embodiments of the present invention, the upper side of the base 110 may have a texture or a pattern.

Alternatively or additionally, one or two inserts into the base where users place their feet may also provide resistance to this counter force. Of course, a combination of anti-slip material covering the inserts may provide the most resistance.

According to embodiments of the present invention, the leg shaft 120 may be extended (by using, for example, a telescopic shaft). According to embodiments of the present invention, the at least one leg support 130 may be cylindrical as shown but it would be appreciated that the shape of the at least one leg support 130 is not limited to being cylindrical and may be any other defined or undefined shape. According to embodiments of the present invention, the at least one leg support 130 may comprise one or more depressions configured to receive user's leg or legs. According to embodiments of the present invention, the leg shaft 120 may be movably connected with the base 110, via a tilting mechanism, using any known in the art suitable way, such as, for example, a hinge, and may be fixed by the user in a plurality of angles relative to the base 110, for example, 100 degrees, 95 degrees, 90 degrees, 85 degrees, 80 degrees etc.

Examples of tilting mechanisms which may be used may include, but are not limited to, a ratchet, a gas piston and the like.

Figure 1A:
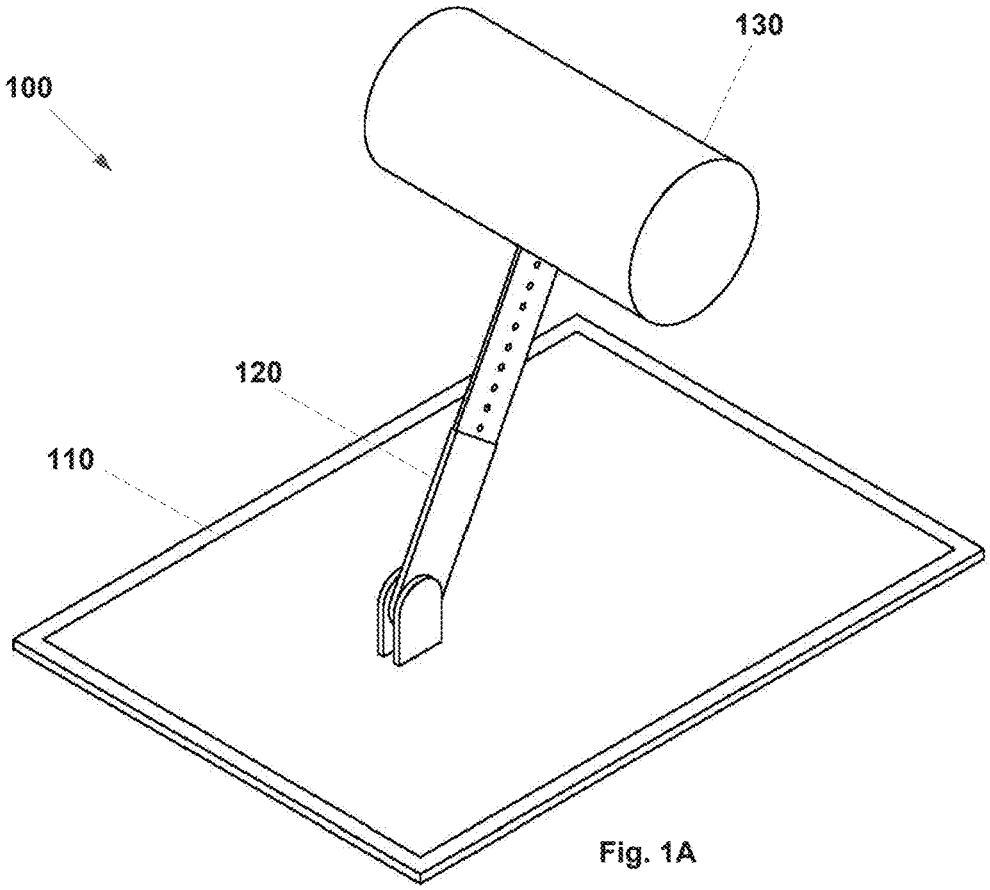
FIG. 1A shows the exemplary plank stand of FIG. 1 with an extended and tilted leg shaft.

FIG. 1A shows the exemplary plank stand of FIG. 1 with an extended and tilted leg shaft 120 resulting in an exemplary position of the at least one leg support 130.

Figure 1B:
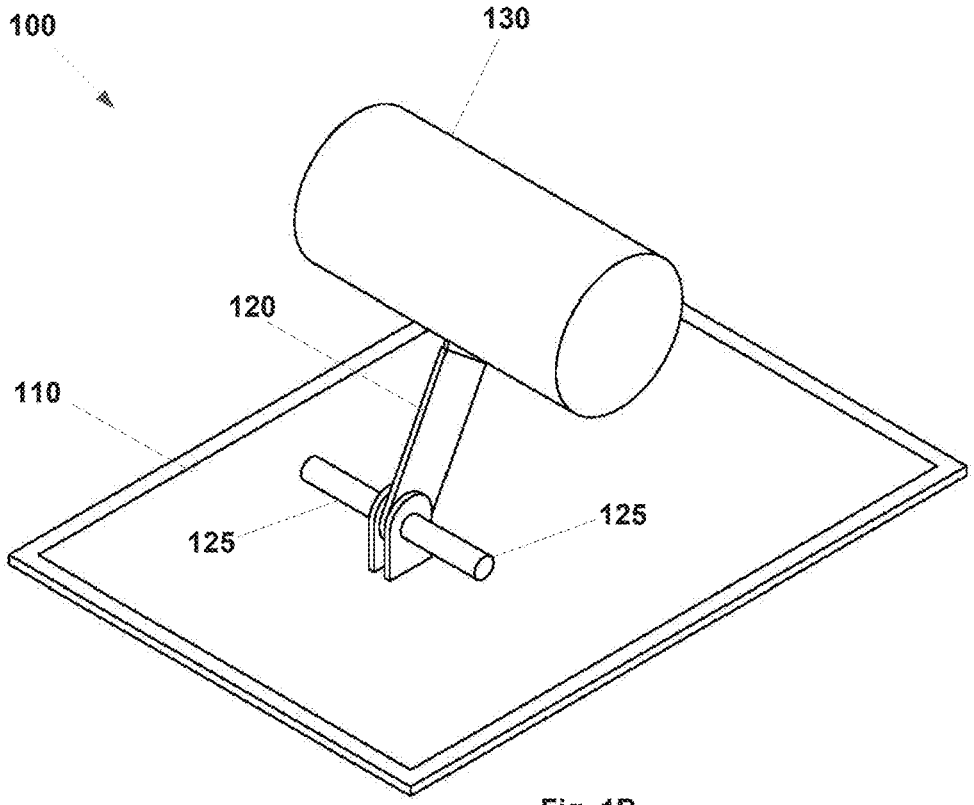
FIG. 1B shows another exemplary embodiment of the plank stand of the present invention.

FIG. 1B shows another exemplary embodiment of the plank stand 100 of the present invention in which the leg shaft 120 may comprise two foot supports 125. The foot supports 125 are intended to enable users to insert their feet beneath the foot support in order to be able to lean back.

Figure 1C:
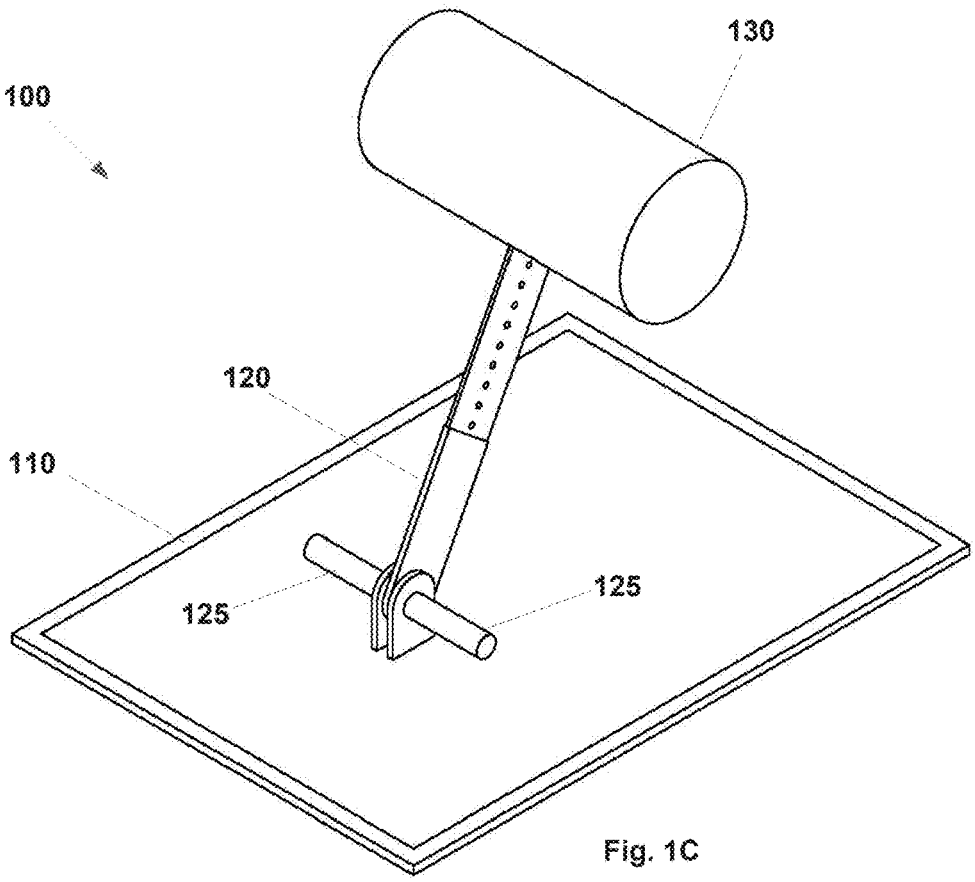
FIG. 1C shows the exemplary plank stand of FIG. 1B.

FIG. 1C shows the exemplary plank stand of FIG. 1B with an extended and tilted leg shaft 120 resulting in an exemplary position of the at least one leg support 130.

Figure 1D:
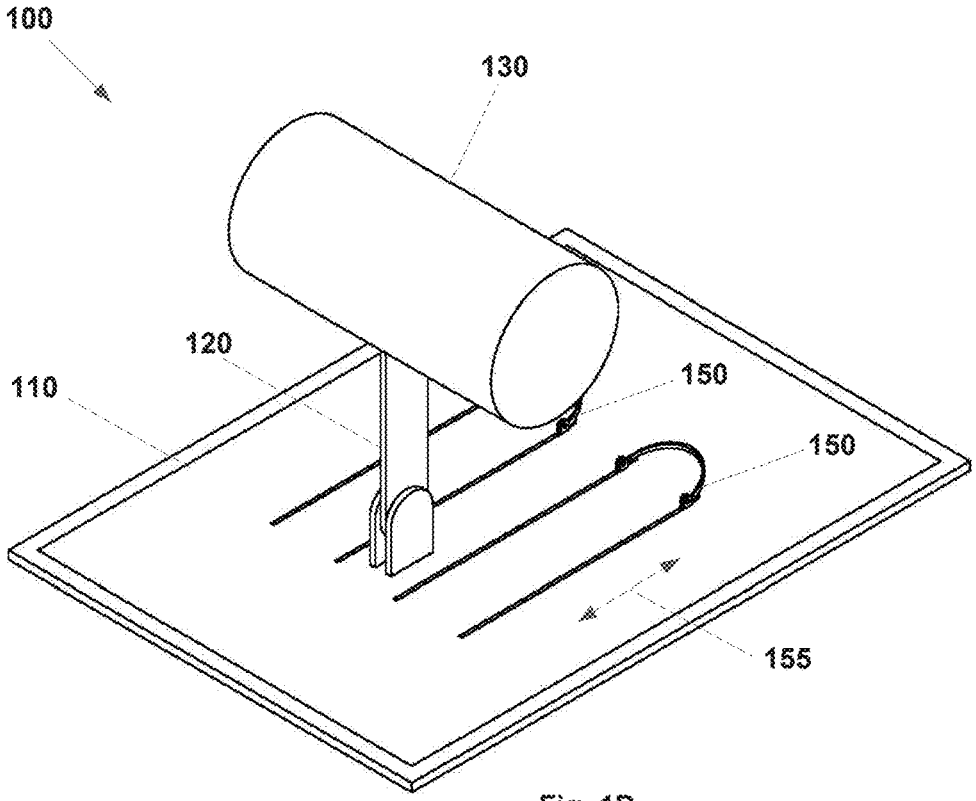
FIG. 1D shows another exemplary embodiment of the plank stand of the present invention.

FIG. 1D shows another exemplary embodiment of the plank stand 100 of the present invention in which the base 110 may comprise two heel supports 150. As the user leans forward, the heels tend to rise from the base. Therefore, the heel supports 150 engage with the users'heels while leaning forward in order to hold their feet. It will be appreciated that the heel supports 150 may be movably connected with the base 110 in order to enable setting of various distances of the heel supports 150 from the leg shaft 120 and thereby enabling various leaning angles of the user. It will be appreciated that the heel supports 150 may be connected in various known in the art ways. For the purpose of demonstration, each heel support 150 is presented as mounted in two rails which enable to move the heel support away and towards the leg shaft 120 in the direction of the double headed arrow 155 and fixate the heel support in a desired location.

Figure 1E:
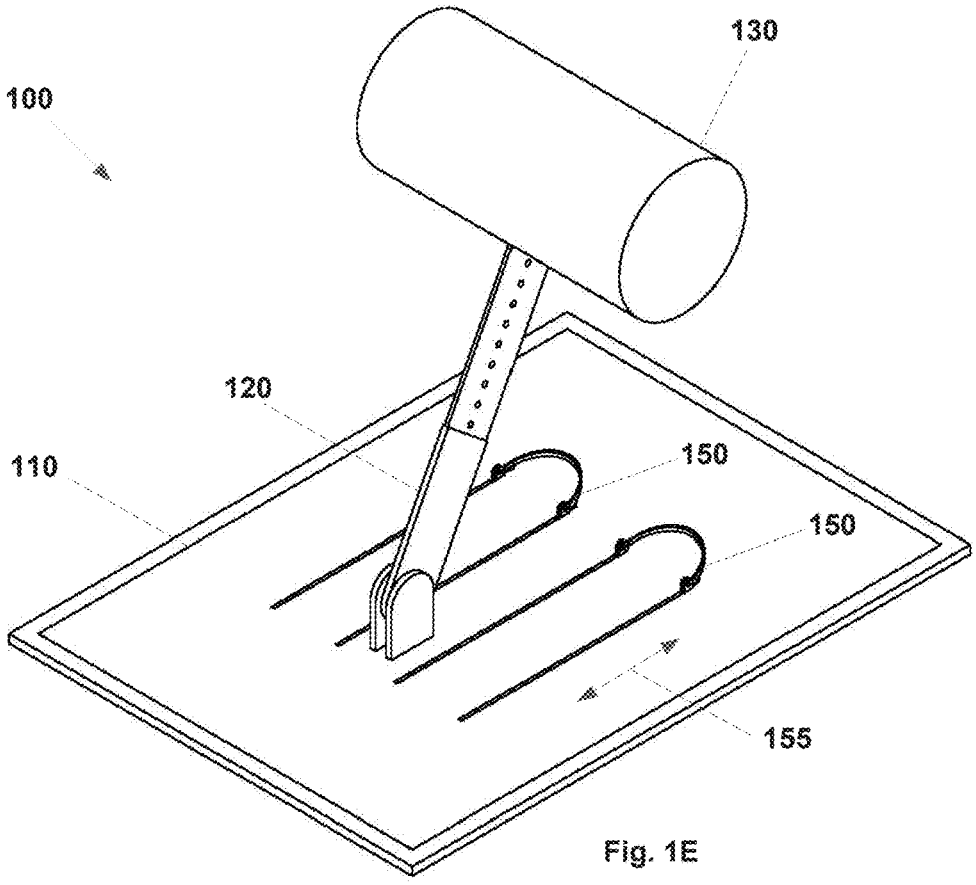
FIG. 1E shows the exemplary plank stand of FIG. 1D with an extended and tilted leg shaft.

FIG. 1E shows the exemplary plank stand of FIG. 1D with an extended and tilted leg shaft 120 resulting in an exemplary position of the at least one leg support 130.

Figure 1F:
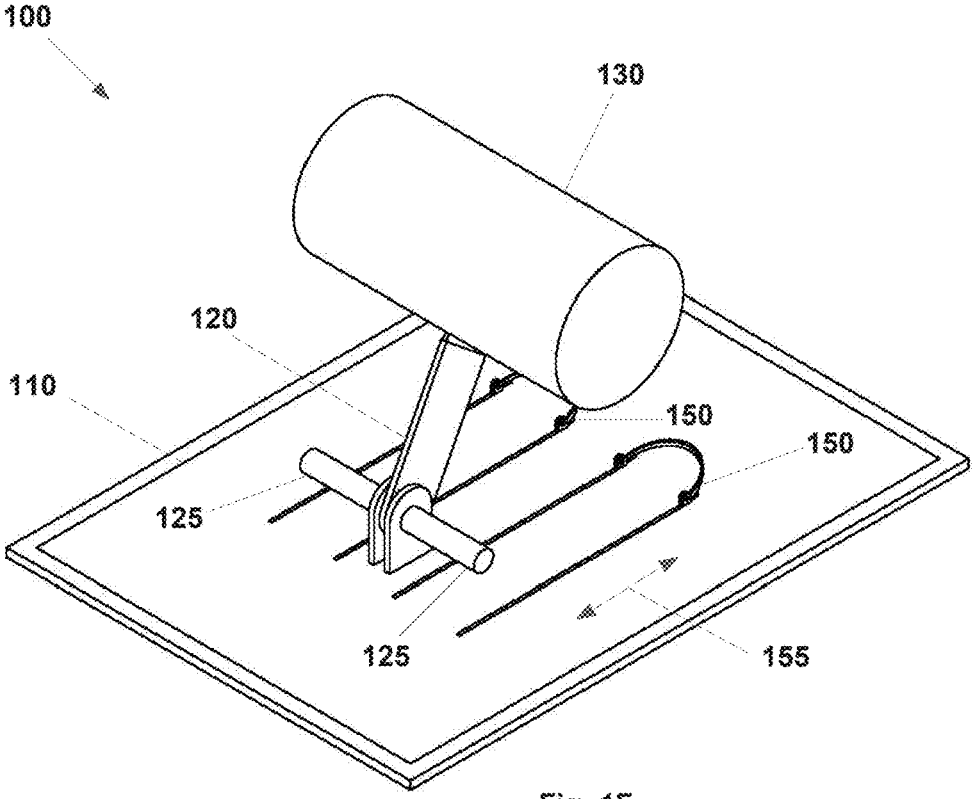
FIG. 1F shows another exemplary embodiment of the plank stand of the present invention.

FIG. 1F shows another exemplary embodiment of the plank stand 100 of the present invention in which the plank stand 100 comprises both the foot supports 125 and heel supports 150.

Figure 1G:
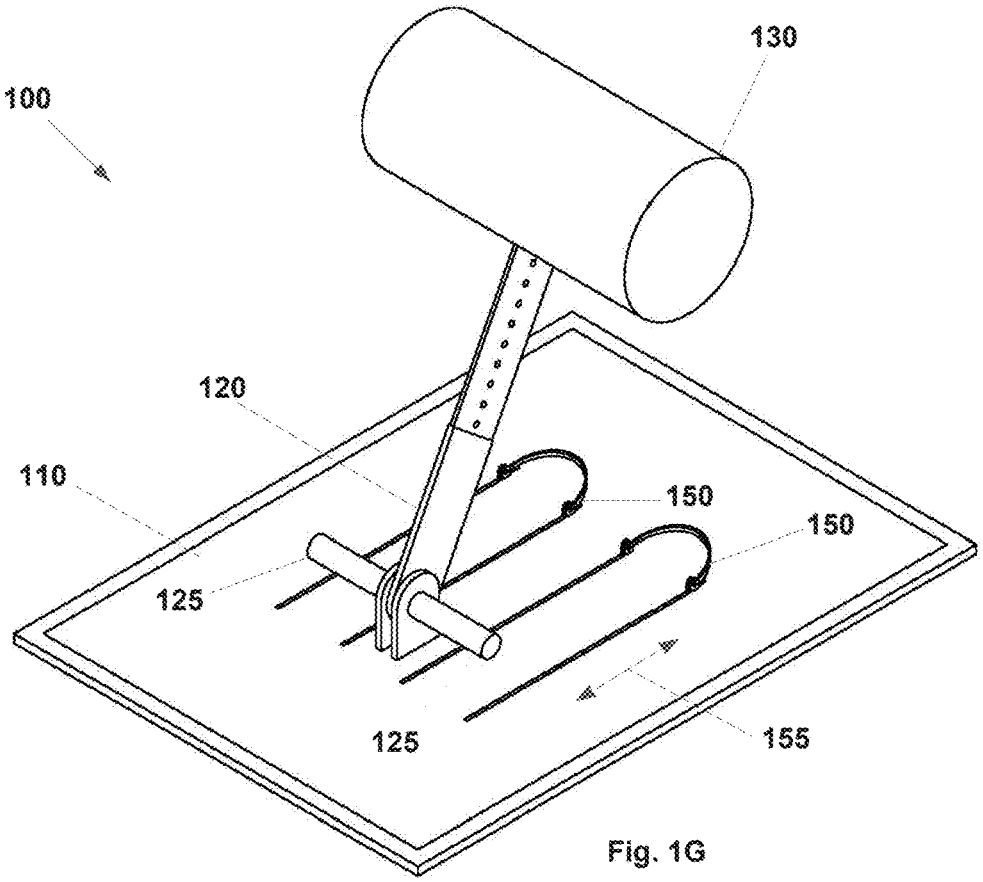
FIG. 1G shows the exemplary plank stand of FIG. 1F with an extended and tilted leg shaft.

FIG. 1G shows the exemplary plank stand of FIG. 1F with an extended and tilted leg shaft 120 resulting in an exemplary position of the at least one leg support 130.

According to embodiments of the present invention, the height of each heel support 150 may be adjusted as necessary, for example, by connecting the heel supports 150 with the base 110 via a hinge, by using elastic material enabling to move the heel supports, or by any known in the art way suitable for adjusting the height of the heel supports 150.

Figure 1H:
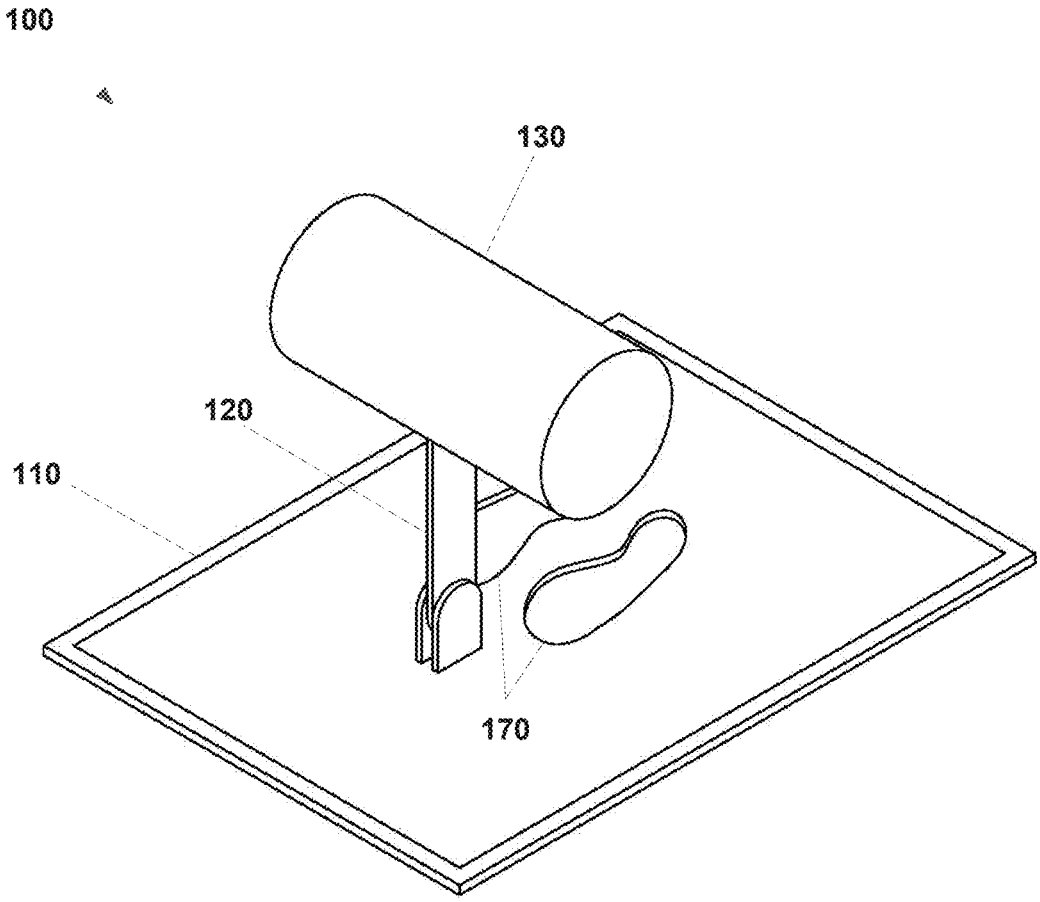
FIG. 1H shows another exemplary embodiment of the plank stand 100 of the present invention.

FIG. 1H shows another exemplary embodiment of the plank stand 100 of the present invention in which the base 110 may comprise two inserts 170 into which users may place their feet. It will be appreciated that the present invention is not limited to two inserts and one insert for both feet may also be used.

Figure 1I:
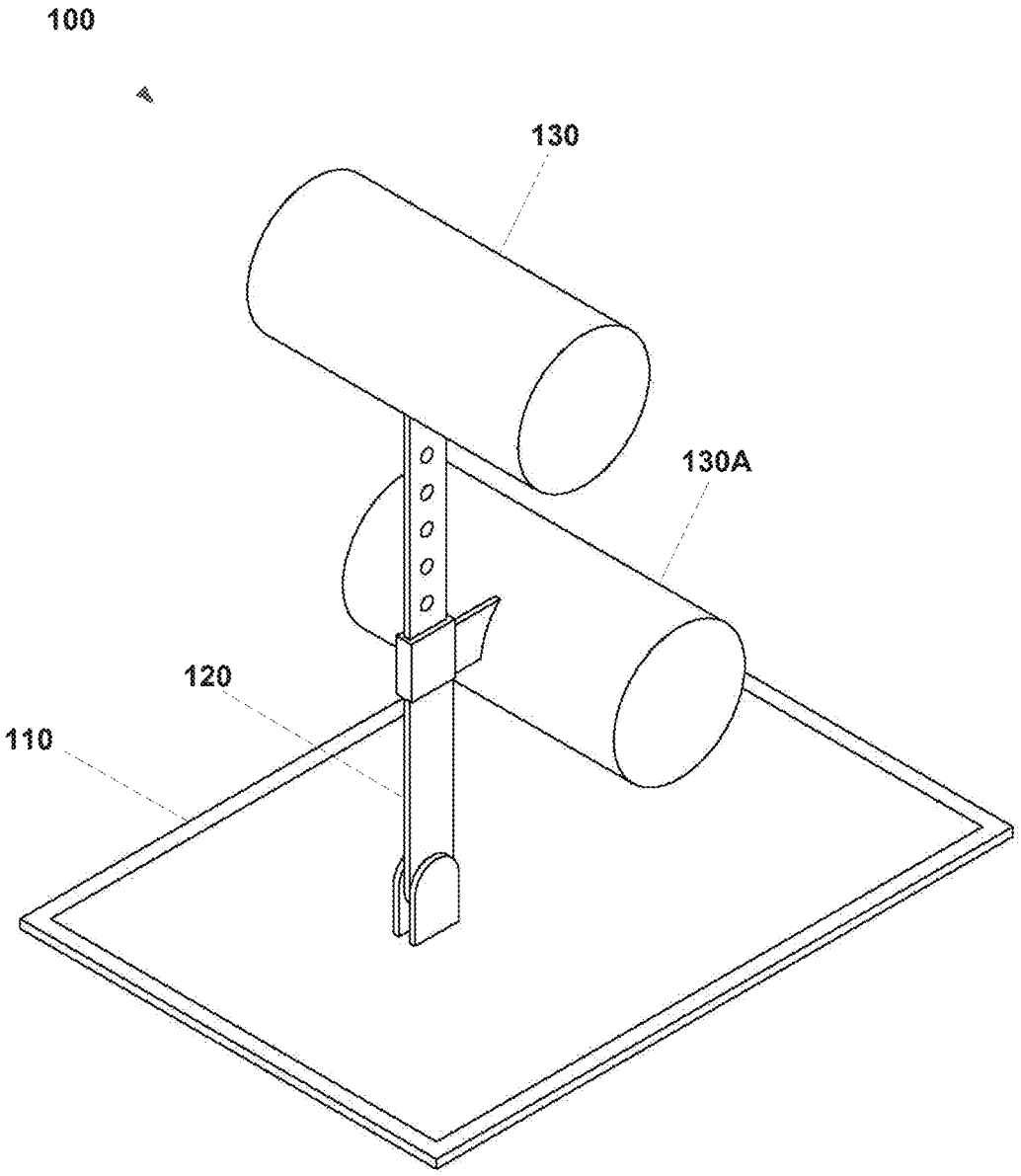
FIG. 1I shows another exemplary embodiment of the plank stand 100 of the present invention.

FIG. 1I shows another exemplary embodiment of the plank stand 100 of the present invention in which the plank stand 100 may comprise at least one additional leg support 130A movably connected with the leg shaft 120. It will be appreciated that the distance of the at least one additional leg support 130A from the leg shaft 120, the height of the at least one additional leg support 130A, and the angle of the at least one additional leg support 130A relative to the leg shaft 120 may be adjusted, as will be described below. It will also be appreciated that the presented embodiment may also comprise any one of the additional features described and shown in conjunction with FIGS. 1B to 1H.

Figure 1J:
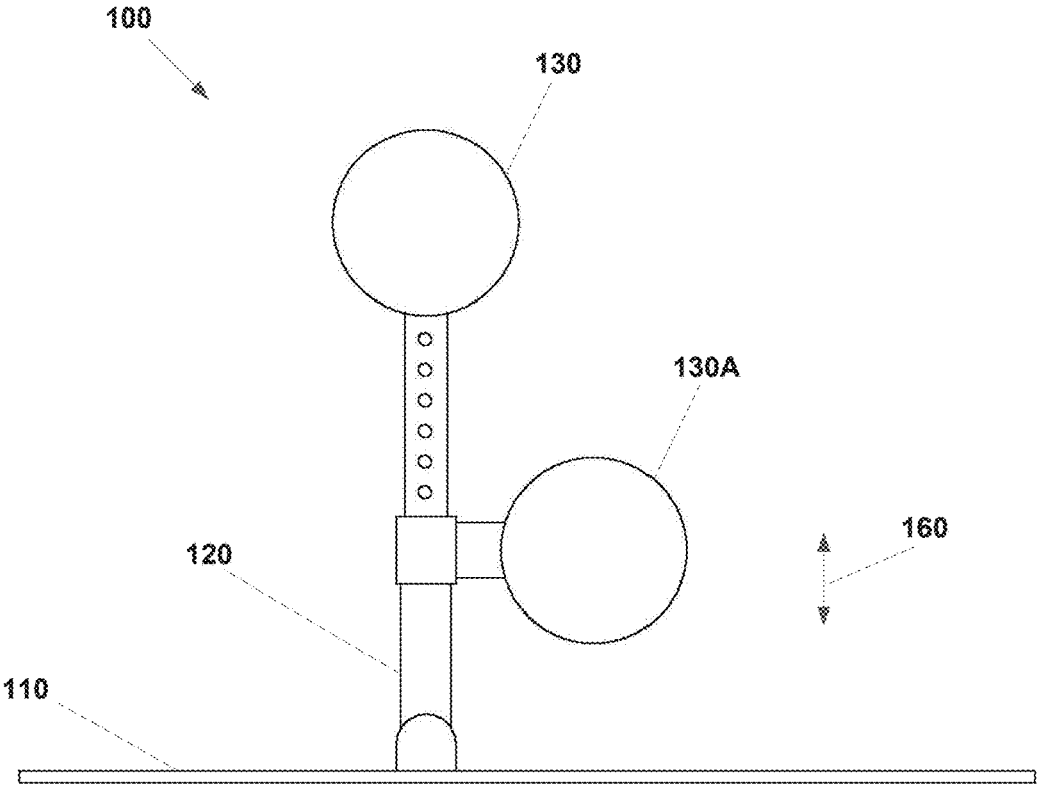
FIG. 1J shows a side view of the embodiment of FIG. 1I.

FIG. 1J shows a side view of the embodiment of FIG. 1I. According to embodiments of the present invention, the at least one additional leg support 130A may be adjusted vertically in the directions of double headed arrow 160.

Figure 1K:
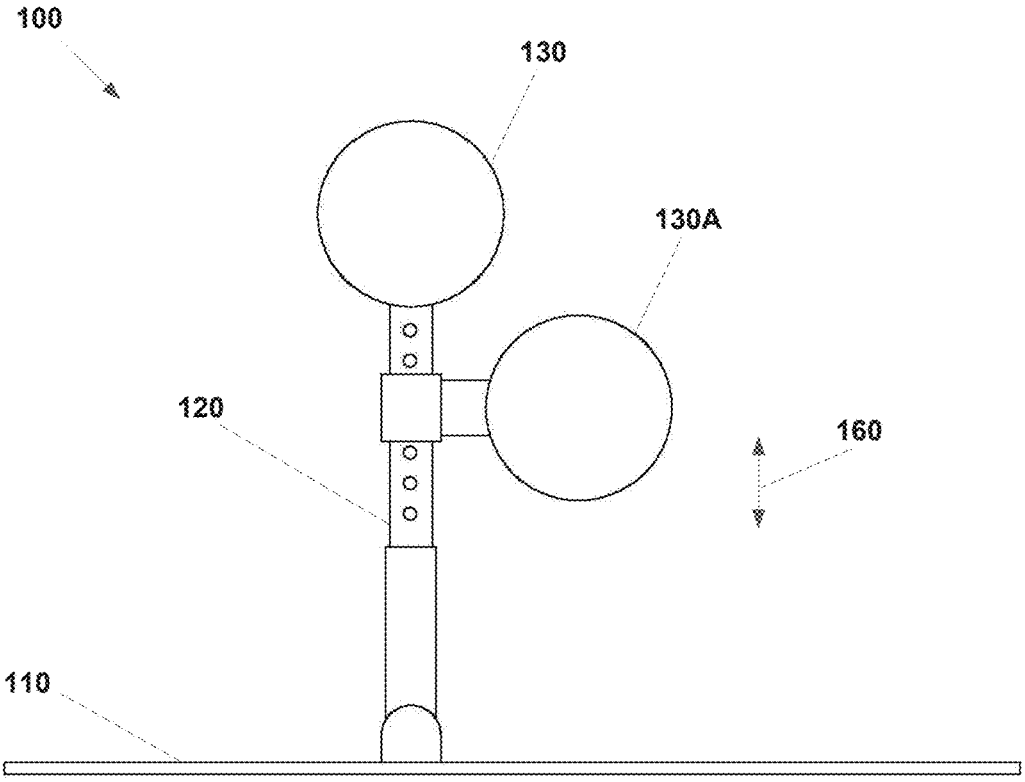
FIG. 1K shows another side view of the embodiment of FIG. 1I.

FIG. 1K shows a side view of the embodiment of FIG. 1I with a different vertical position of the at least one additional leg support 130A.

Figure 1L:
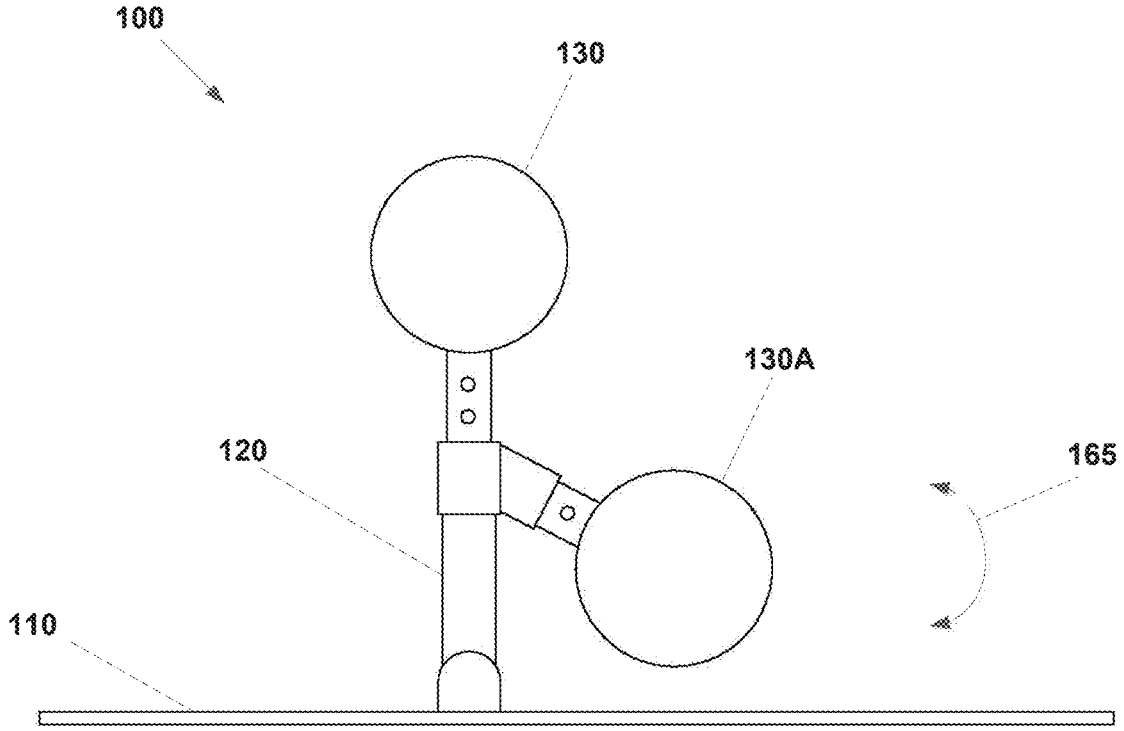
FIG. 1L shows another side view of the embodiment of FIG. 1I.

FIG. 1L shows a side view of the embodiment of FIG. 1I with a different angle of the at least one additional leg support 130A. According to embodiments of the present invention, the angle of the at least one additional leg support 130A relative to the leg shaft 120 may be adjusted in the directions of the double headed arrow 165.

Figure 1M:
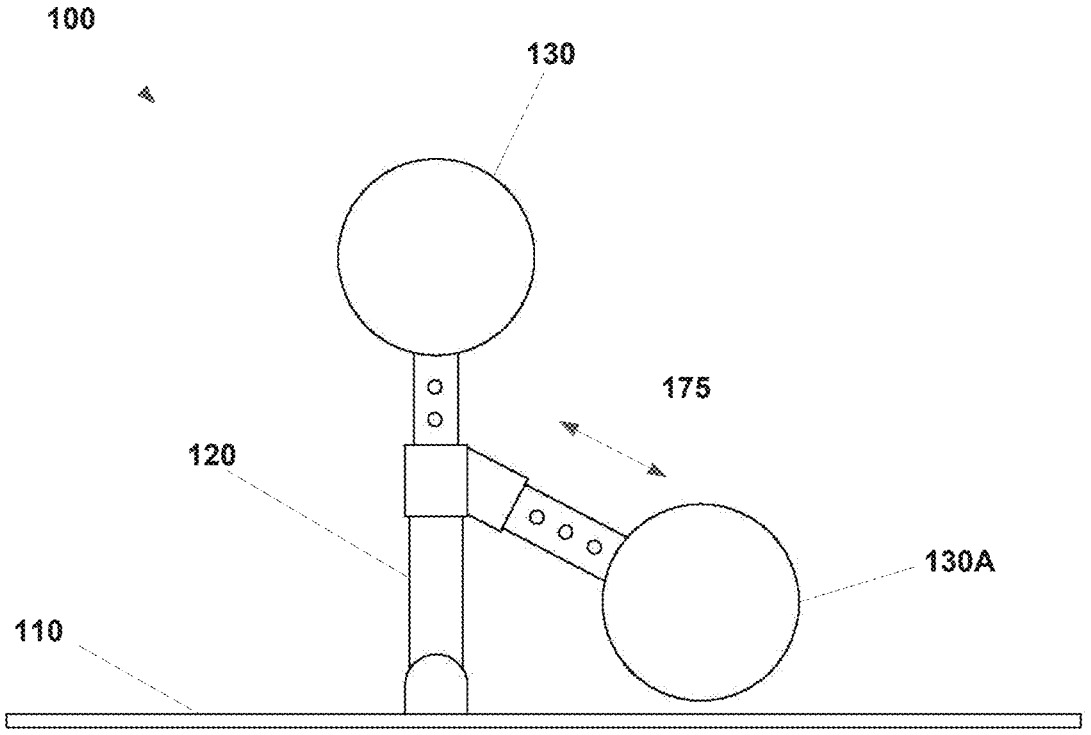
FIG. 1M shows another side view of the embodiment of FIG. 1I.

FIG. 1M shows a side view of the embodiment of FIG. 1I with a different horizontal position of the at least one additional leg support 130A. According to embodiments of the present invention, the at least one additional leg support 130A may be adjusted horizontally in the directions of double headed arrow 175. Please note the horizontal position represents the distance of the additional leg support leg shaft 120 from the leg shaft 120. Therefore, in the presented exemplary embodiment, the double headed arrow 175 is tilted.

It will be appreciated that the at least one additional leg support 130A may comprise and/or be connected with the leg shaft with any suitable mechanism allowing vertical, horizontal and angular adjustment, such as, for example, a telescopic mechanism, clamp, rail and the like.

It will be appreciated that, according to embodiments of the present invention, the at least one leg support 130 may be movably connected with the leg shaft 120.

Figure 1N:
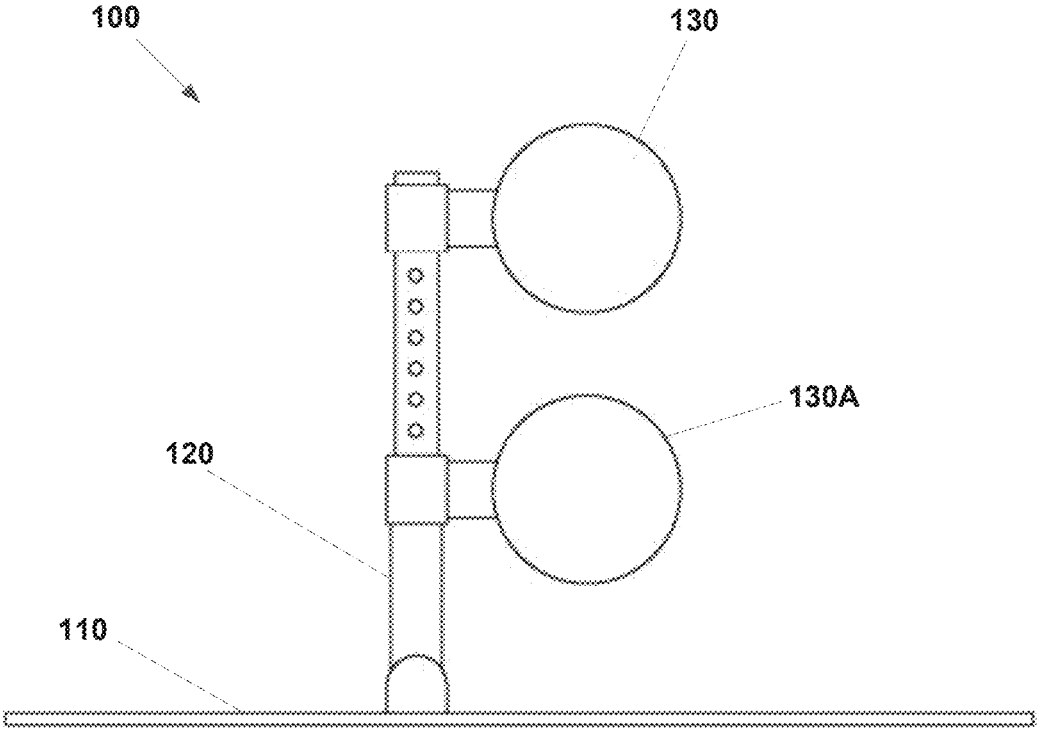
FIG. 1N shows another exemplary embodiment of the plank stand of the present invention.

FIG. 1N shows another exemplary embodiment of the plank stand 100 of the present invention in which the at least one leg support 130 is movably connected with the leg shaft 120.

Figure 2:
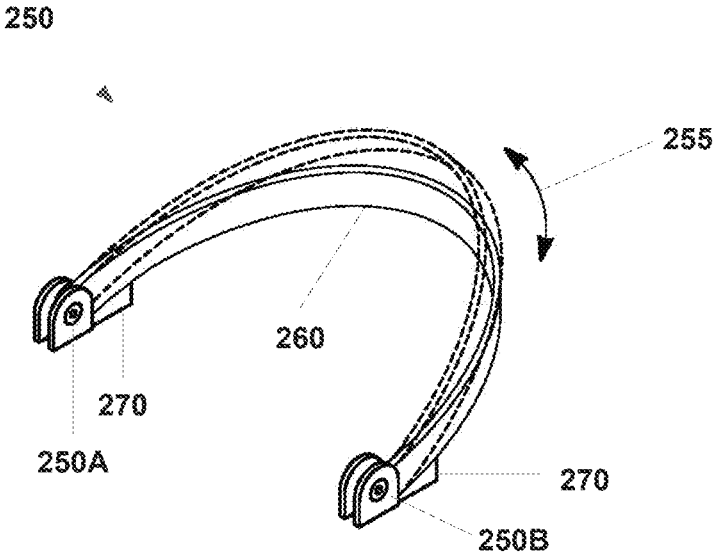
FIGS. 2A and 2B show two exemplary positions of the heel support of FIG. 2.

For the purpose of demonstration only, FIG. 2 shows an exemplary heel support 250 comprising two hinges 250A and 250B, one on each side of the U-shaped member 260, enabling to adjust the height of the U-shaped member 260 in the direction of the double headed arrow 255. The heel support 250 further comprises an elevation mechanism (extruding element) intended to keep the U-shaped member elevated so that the user is not required to raise the U-shaped member into position with the heel when stepping onto the base (not shown), for example, wedges 270 under the U-shaped member 260. This is one example only of how the U-shaped member of the heel support may be kept in the raised position, and many other ways are possible. It will be appreciated that at least one extruding element may be used.

Figure 2B:
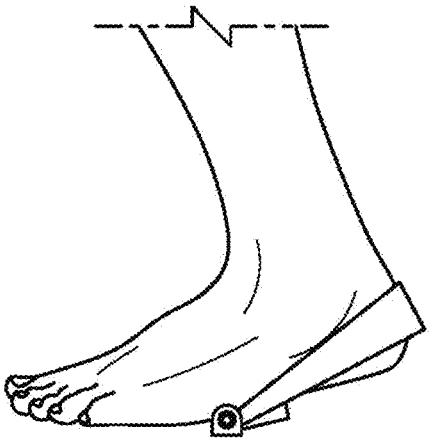
Figure 2A:
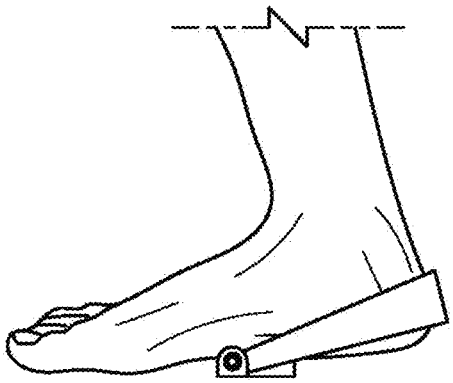

FIGS. 2A and 2B show two exemplary positions of the heel support 250 engaging with a user's heel.

FIG. 2A shows an initial position of the user's heel.

FIG. 2B shows the position of the user's heel when leaning forward.

For the purpose of demonstration, the following FIGS. 3A to 3I show a plurality of exemplary positions one may utilize using the plank stand 100 of the present invention. It will be appreciated that the various exemplary positions are presented using the embodiment of FIG. 1F but may also be utilized using any one of the embodiments described above.

Figure 3A:
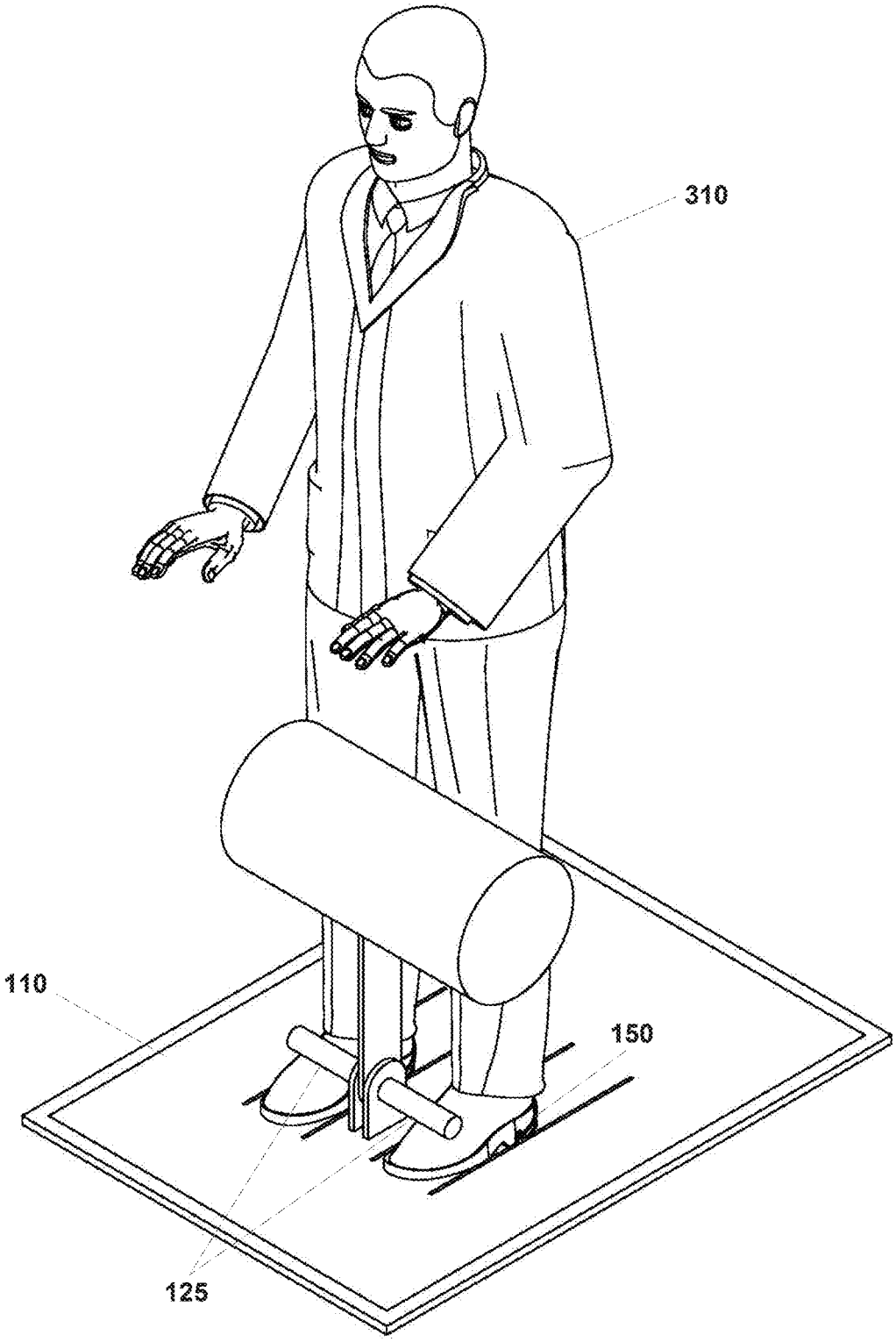
FIGS. 3A to 3I show a plurality of exemplary positions one may utilize using the plank stand of the present invention.

FIG. 3A shows an exemplary front perspective view of a user 310 standing on the base 110, inserting his feet under the foot supports 125 and adjusting the heel supports 150 to engage with his heels.

Figure 3B:
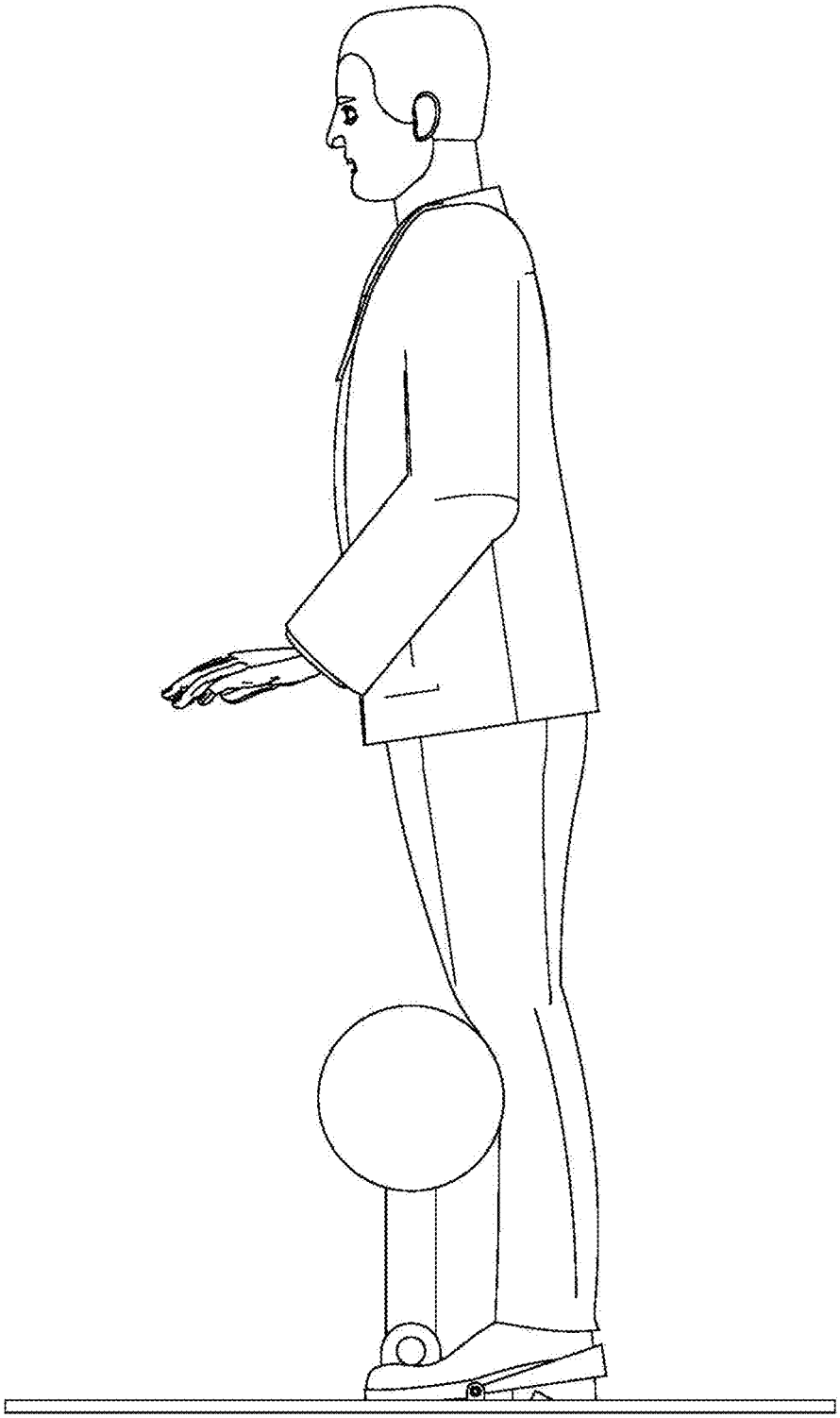

FIG. 3B shows a side view of FIG. 3A. From this figure it is evident that even a small inclination (1-3 degrees) achieves the goal of shifting a large proportion of stress and pressure from the spine and skeletal frame to the abdomen and back muscles.

Figure 3C:
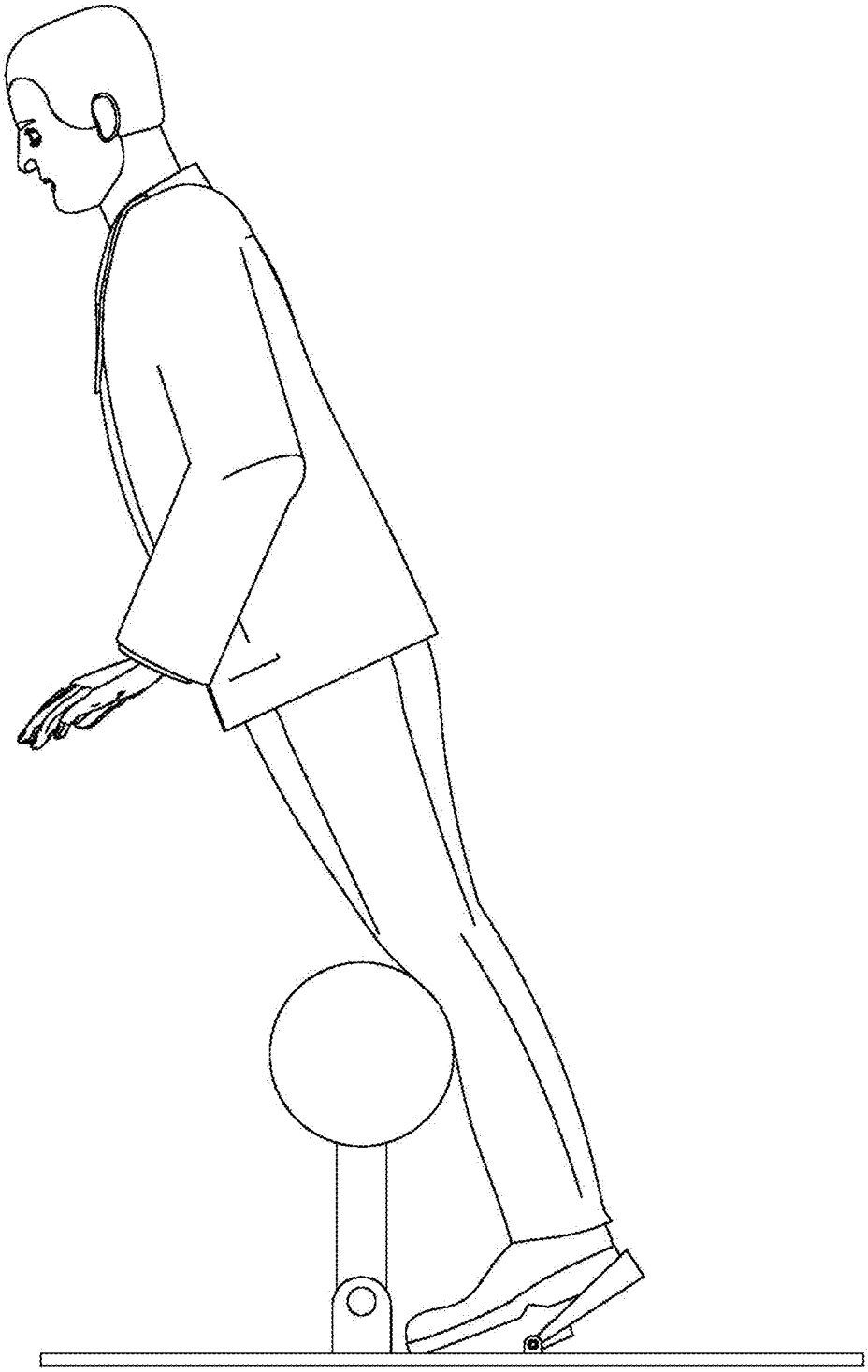

FIG. 3C shows a side view of the user 310 utilizing the configuration of FIG. 3A, by leaning forward.

Figure 3D:
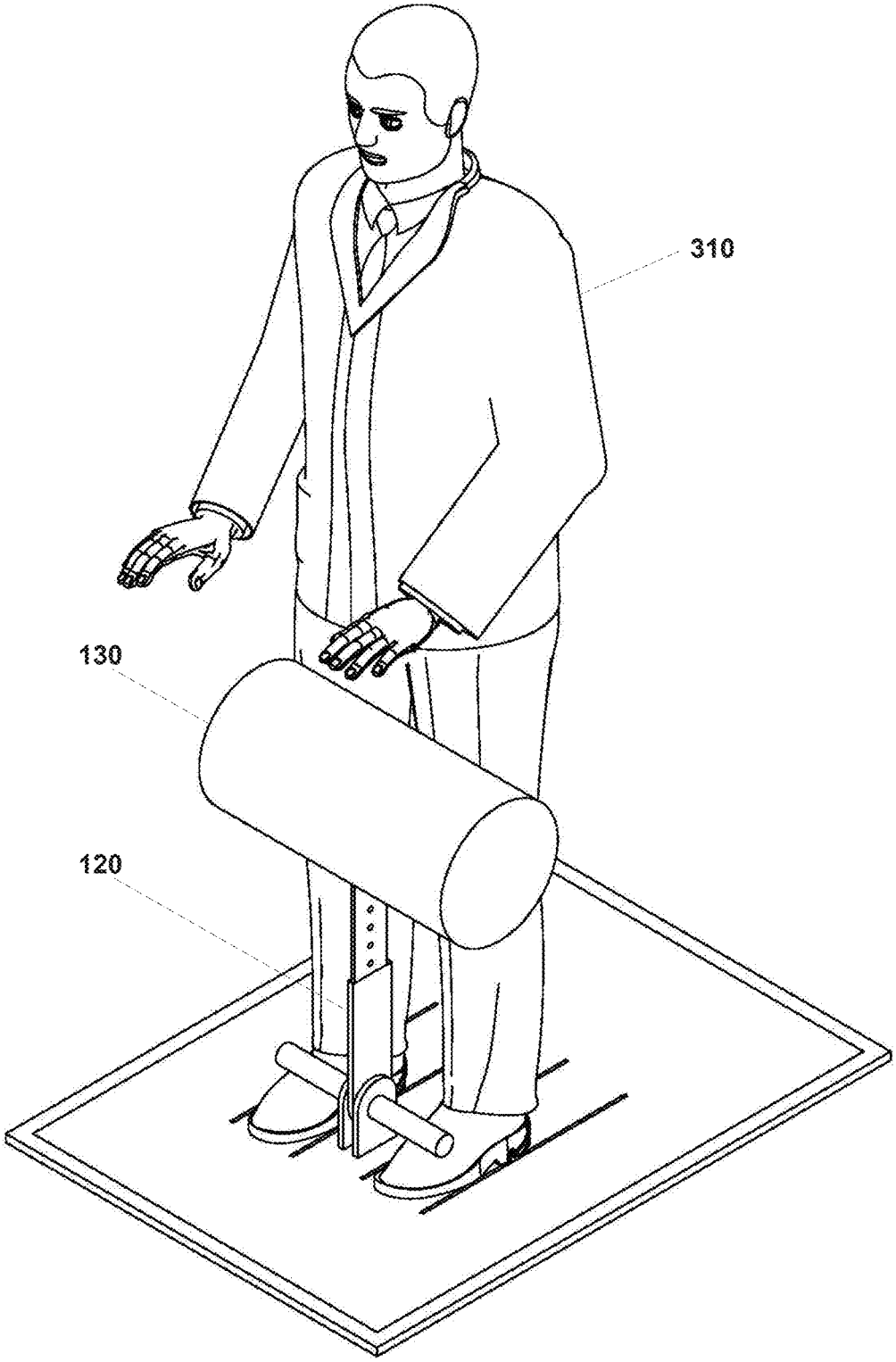

FIG. 3D shows another exemplary front perspective view of the user 310 when the leg shaft 120 is extended in order to adjust the height of the leg support 130 as desired for changing the leaning angle.

Figure 3E:
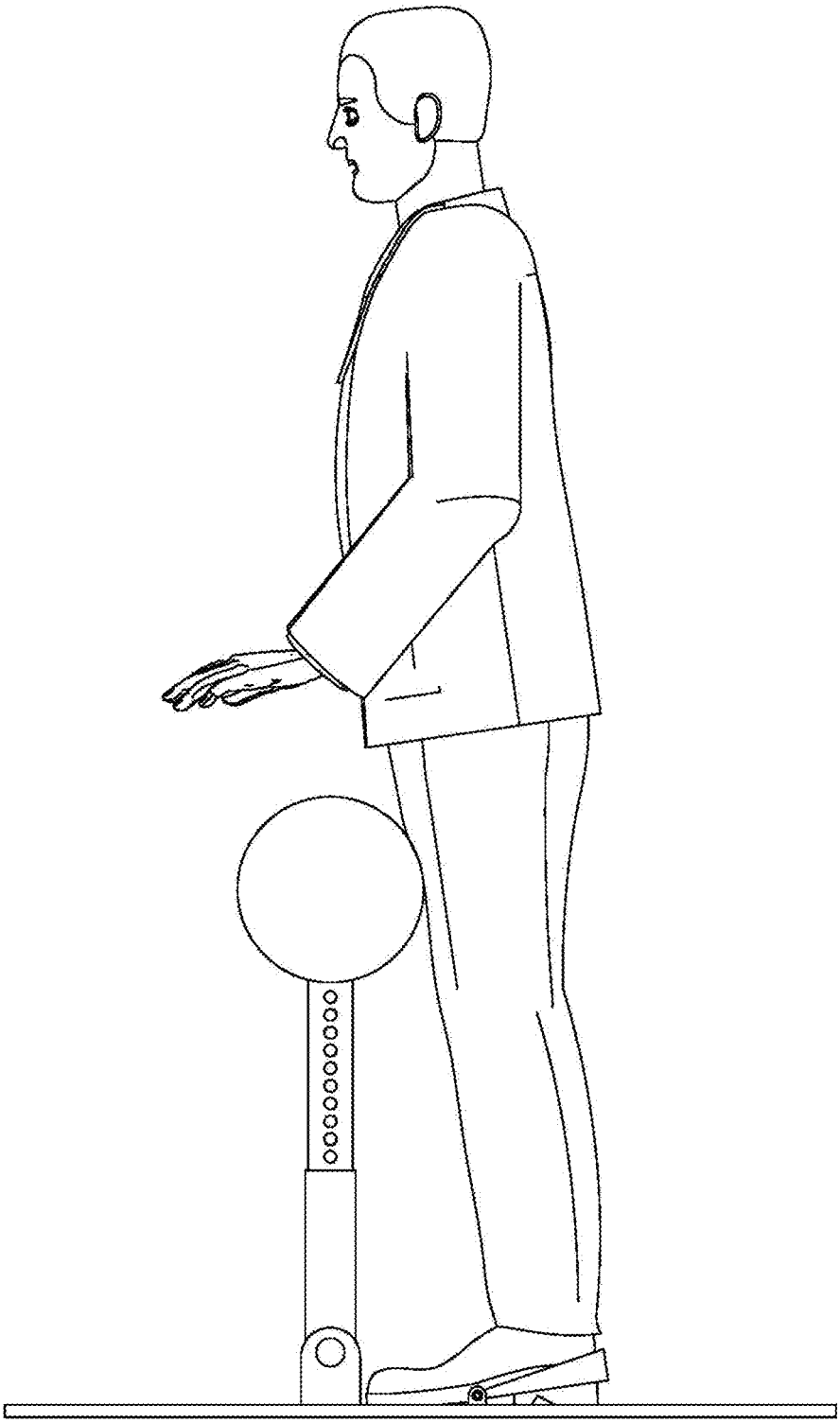

FIG. 3E shows a side view of FIG. 3D.

Figure 3F:
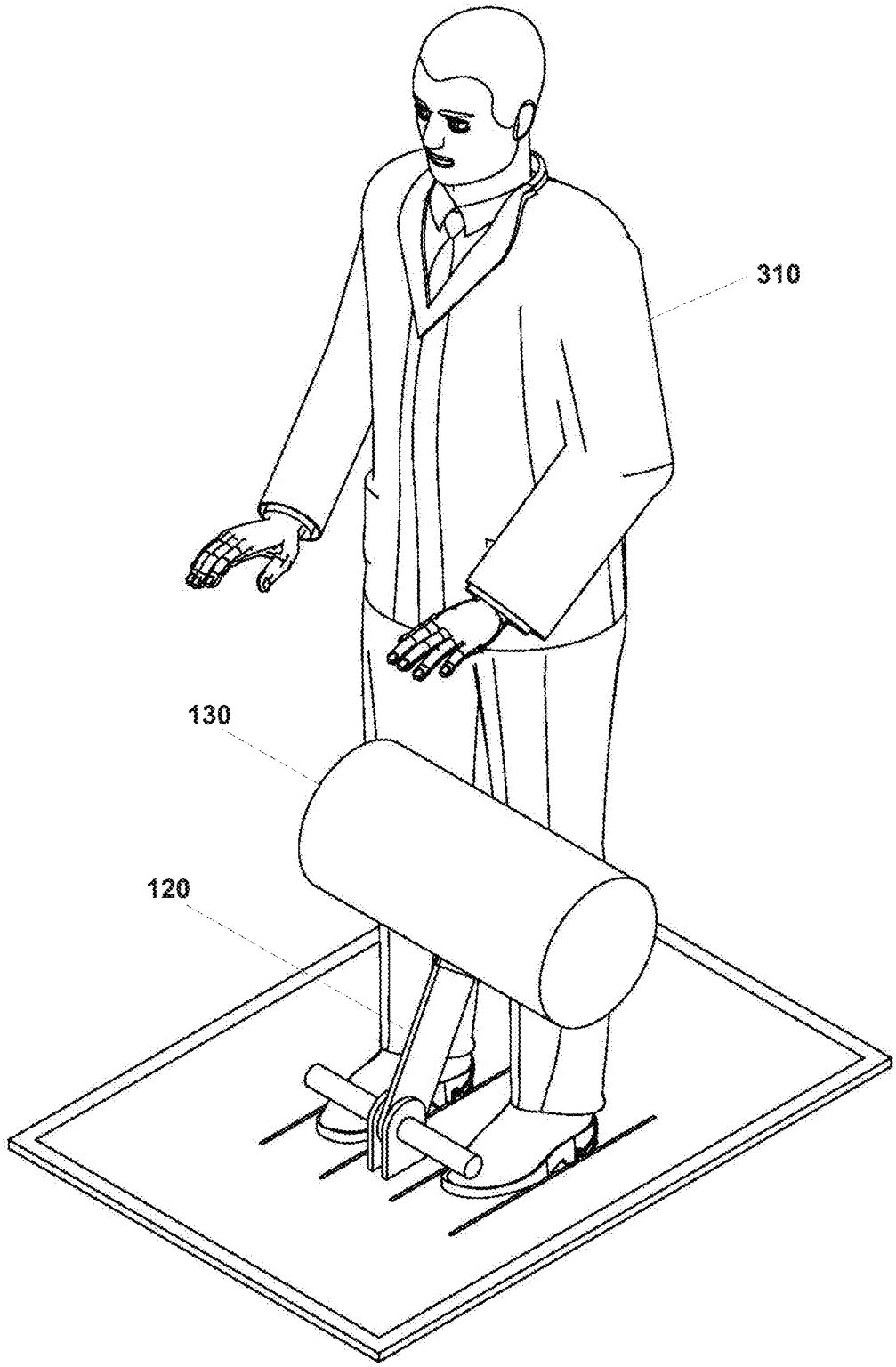

FIG. 3F shows another exemplary front perspective view of the user 310 when the leg shaft 120 is tilted towards the user, thereby changing the position of the leg support 130 and the leaning angle of the user.

Figure 3G:
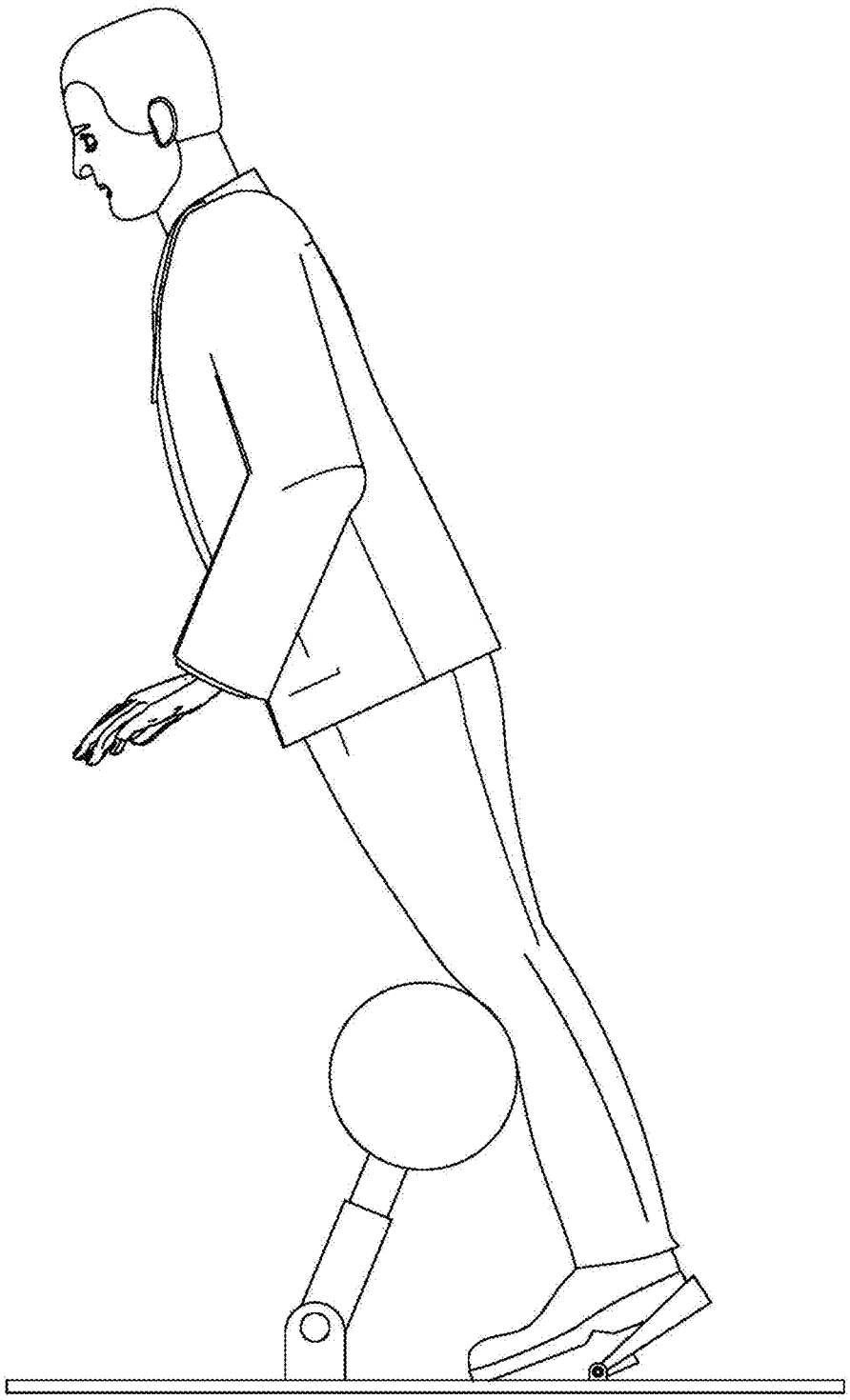

FIG. 3G shows a side view of the user 310 utilizing the configuration of FIG. 3A, by leaning forward.

Figure 3H:
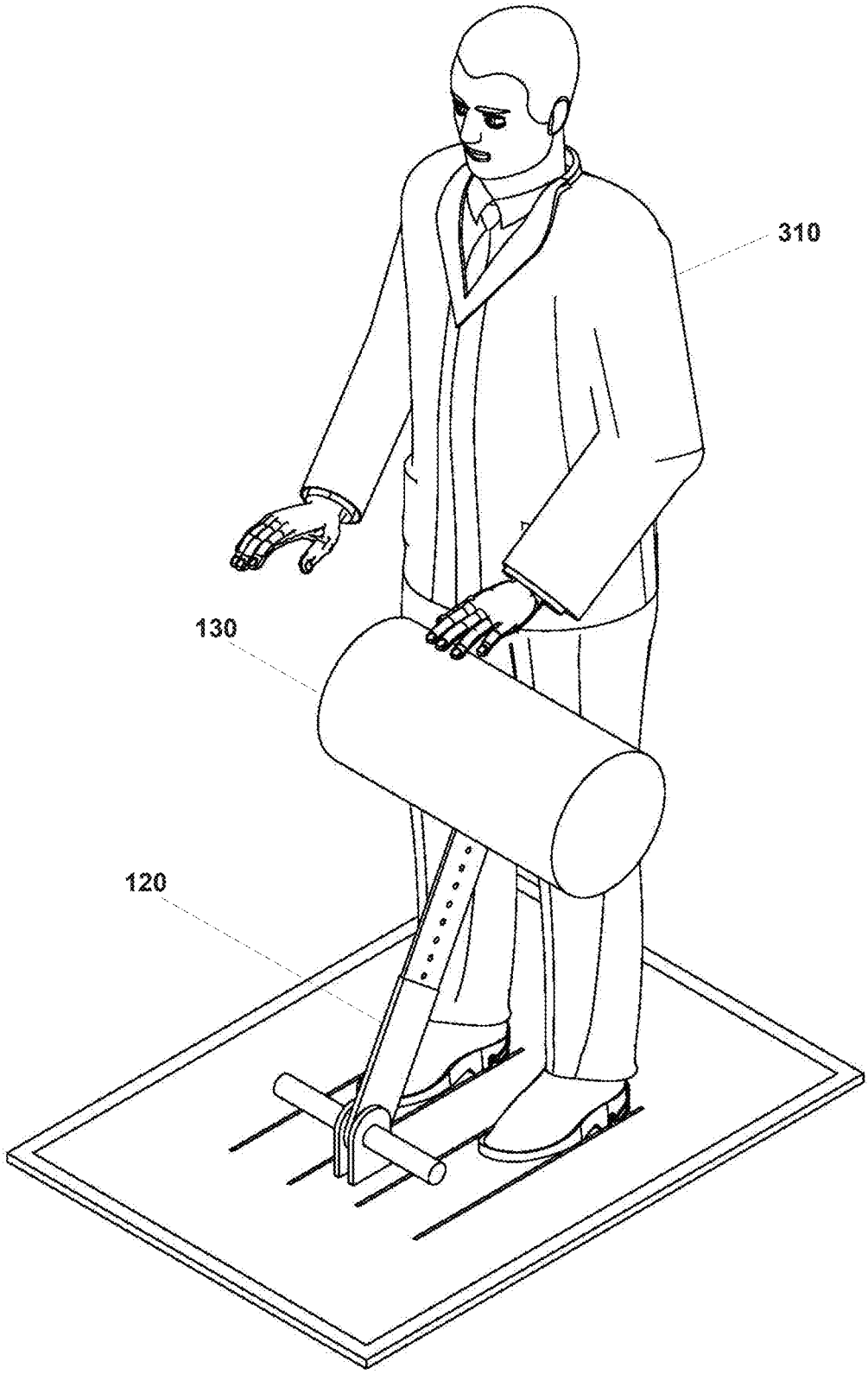

FIG. 3H shows another exemplary front perspective view of the user 310 when the leg shaft 120 is extended in order to adjust the height of the at least one leg support 130, and tilted towards the user as desired for changing the leaning angle.

Figure 3I:
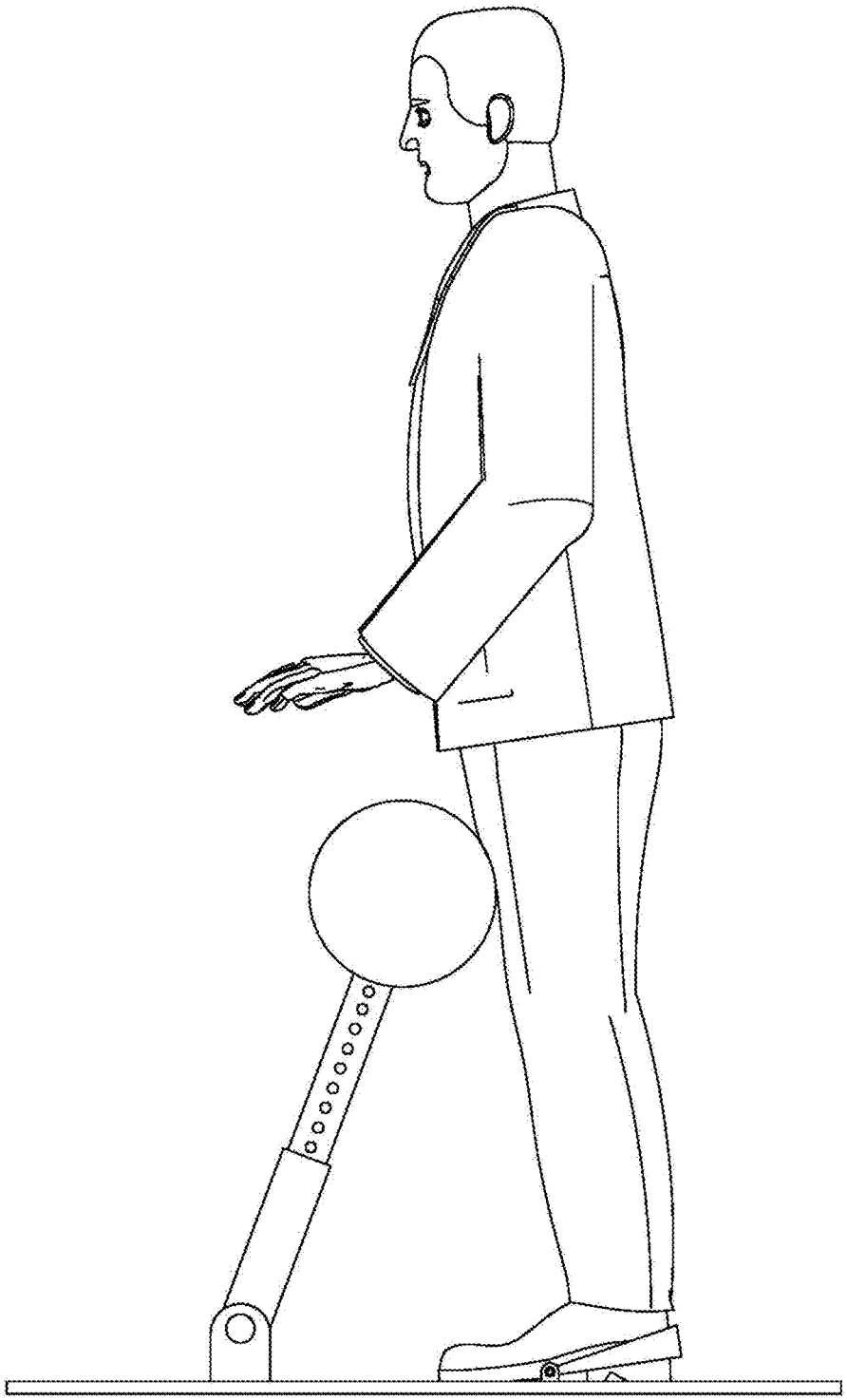

FIG. 3I shows a side view of FIG. 3H.

According to embodiments of the present invention, instead of the at least one leg support 130, a chair may be connected with the leg shaft 120. In such an embodiment, users may support their weight with the chair, but with the torso leaning forward as with the leg support.

Figure 4A:
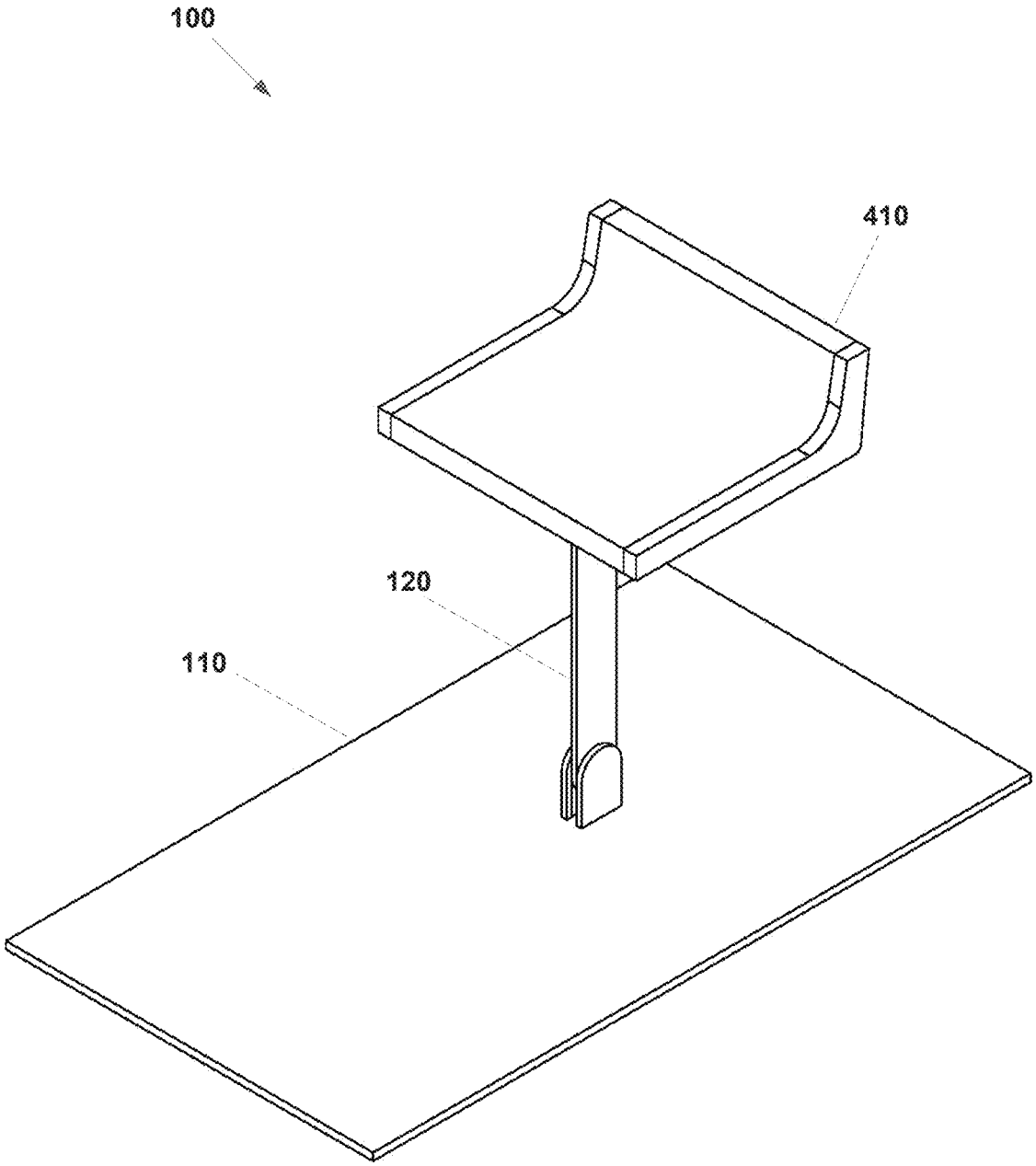
FIG. 4A shows a front perspective view of another exemplary embodiment of the plank stand of present invention.

FIG. 4A shows a front perspective view of another exemplary embodiment of the plank stand 100 of present invention in which the plank stand 100 comprises a base 110, a leg shaft 120, movably connected with the base 110, and a chair 410 movably connected with the leg shaft 120. The chair 410 may be movably connected with the leg shaft 120, via a tilting mechanism, using any known in the art suitable way, such as, for example, a hinge, and may be fixed by the user in a plurality of angles relative to the base 110, for example, 100 degrees, 95 degrees, 90 degrees, 85 degrees, 80 degrees etc. Examples of tilting mechanisms used may include, but are not limited to a spring, a gas piston and the like.

Figure 4B:
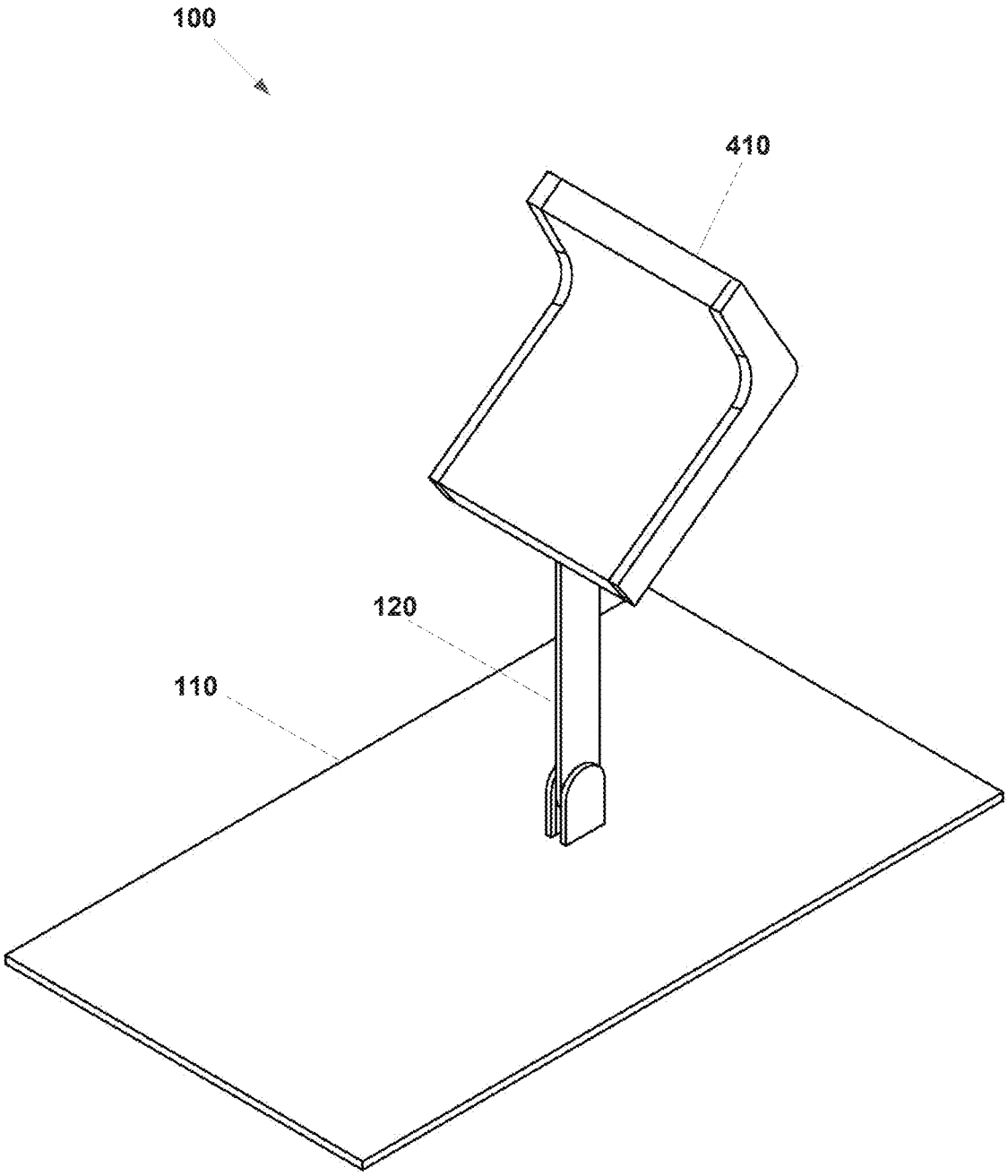
FIG. 4B shows a front perspective view of an exemplary position of the chair.

FIG. 4B shows a front perspective view of an exemplary position of the chair 410 in respect to the base 110.

Figure 4C:
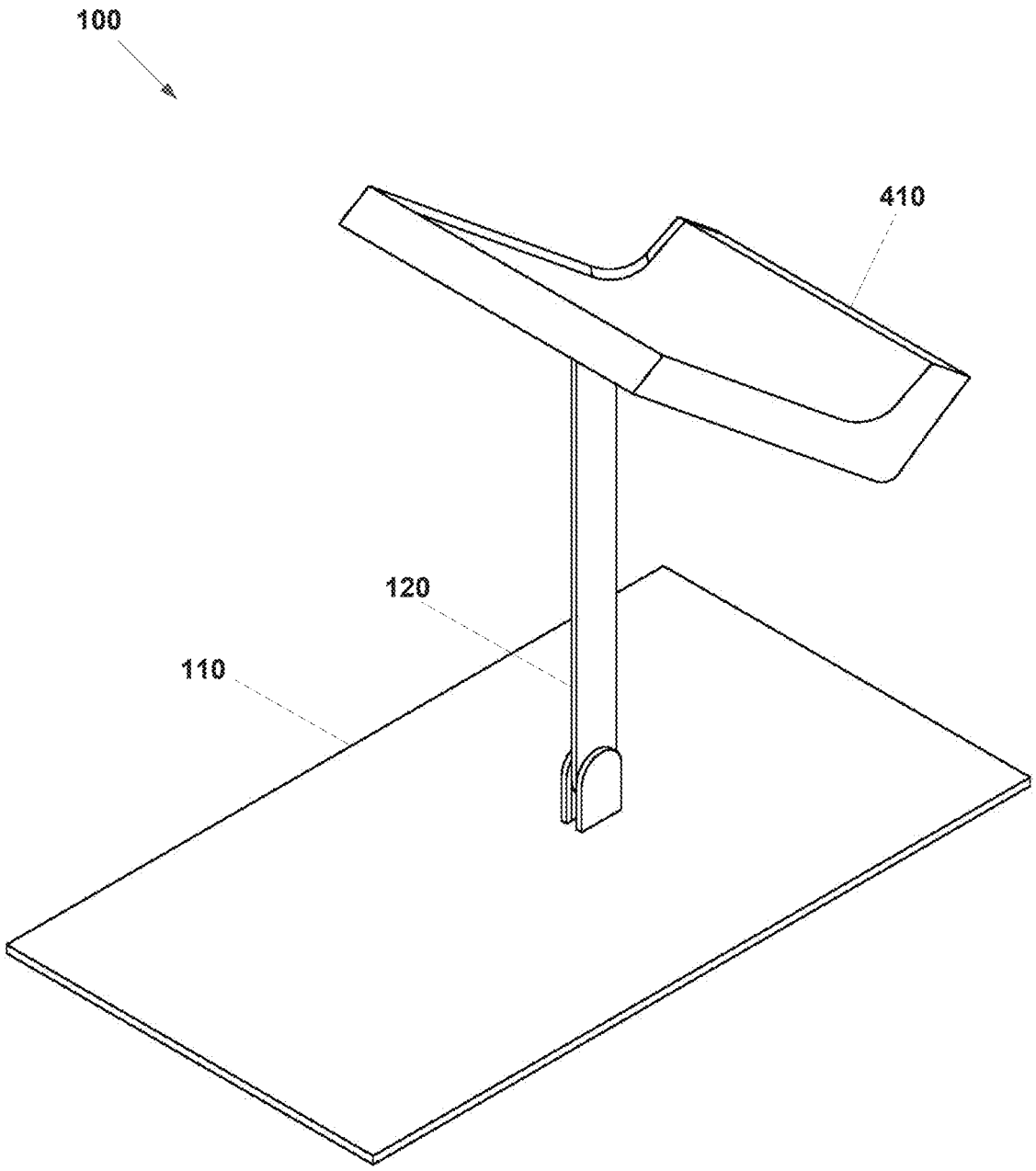
FIG. 4C shows a front perspective view of another exemplary position of the chair.

FIG. 4C shows a front perspective view of another exemplary position of the chair 410 in respect to the base 110.

As mentioned above, the leg shaft 120 may be telescopic.

Figure 4D:
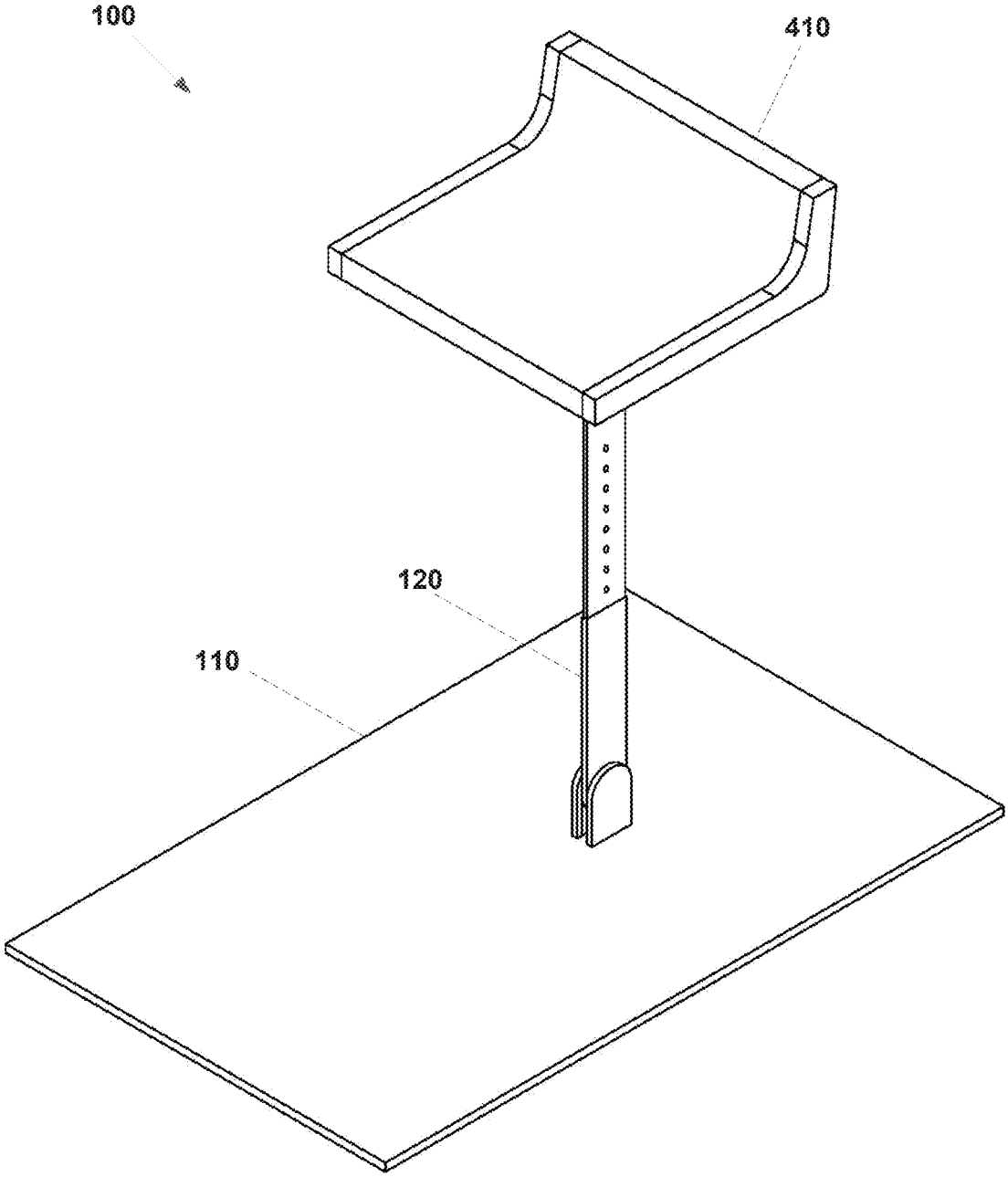
FIG. 4D shows a front perspective view of the configuration of FIG. 4A with an extended leg shaft.

FIG. 4D shows a front perspective view of the configuration of FIG. 4A with an extended leg shaft 120.

Figure 5A:
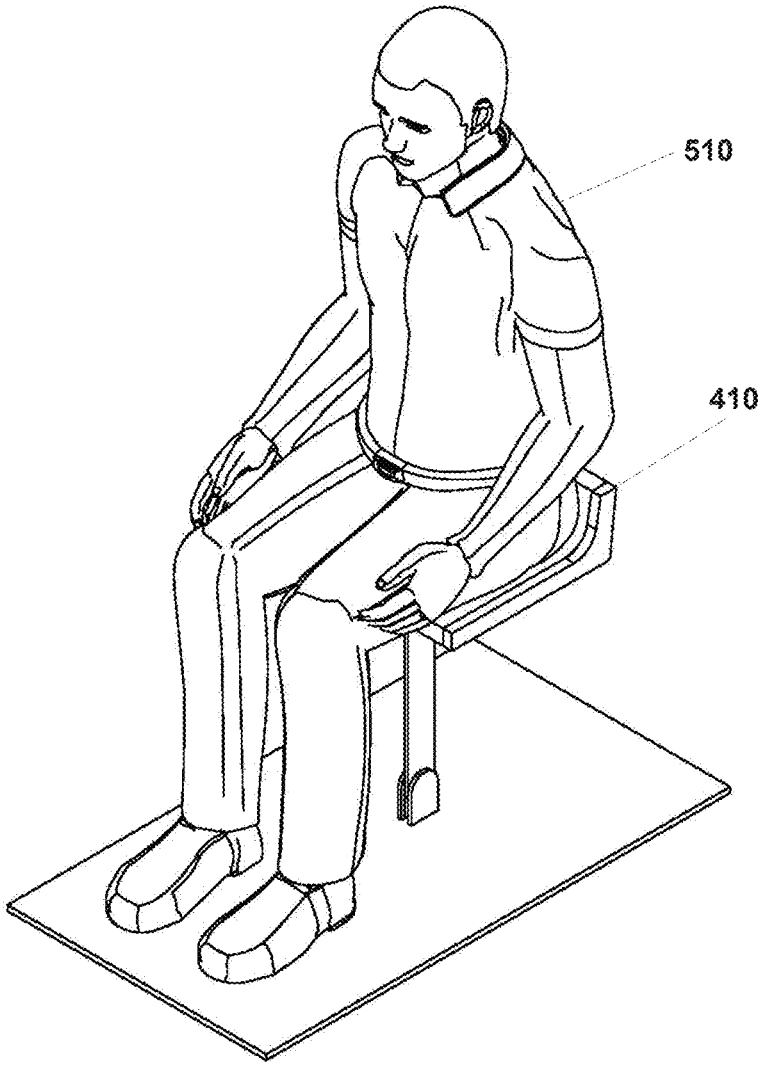
FIG. 5A shows an exemplary front perspective view of a user using the plank stand of FIG. 4A.

FIG. 5A shows an exemplary front perspective view of a user 510 using the plank stand of FIG. 4A by sitting on the chair 410.

Figure 5B:
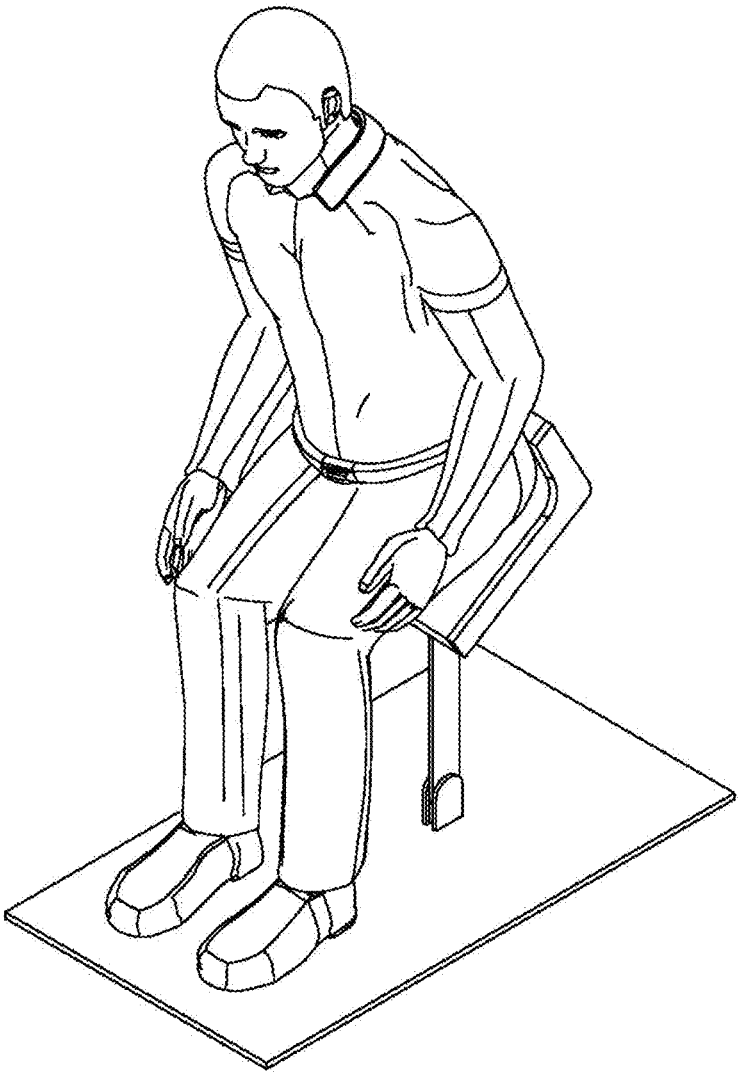
FIG. 5B shows a front perspective view of a user utilizing the configuration of FIG. 4A by leaning forward.

FIG. 5B shows a front perspective view of the user 510 utilizing the configuration of FIG. 4A, by leaning forward.

Figure 5C:
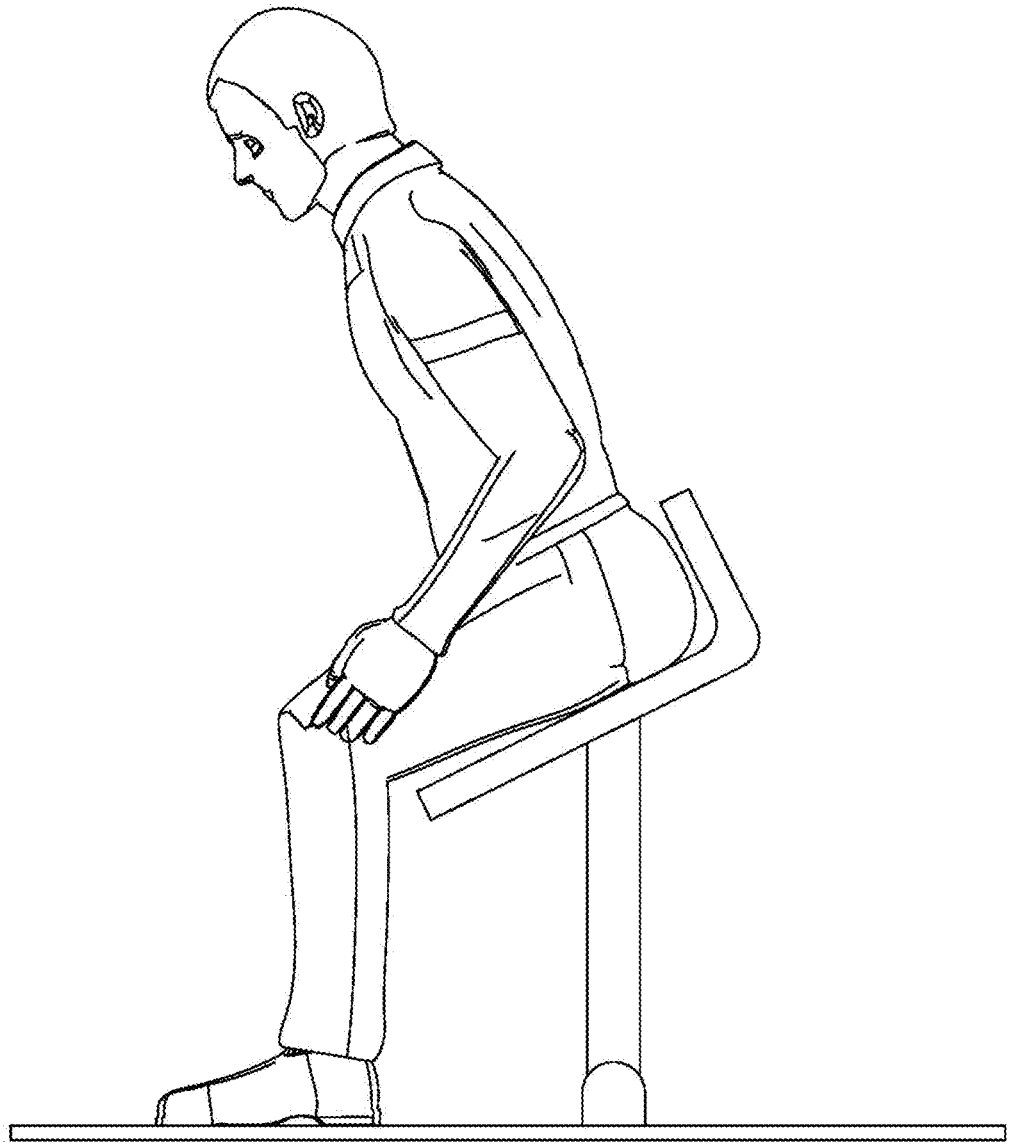
FIG. 5C shows a side view of FIG. 5B.

FIG. 5C shows a side view of FIG. 5B.

It will be appreciated that the configuration of FIG. 4A may further comprise foot supports 125 and/or heel supports 150 as explained above.

Figure 5D:
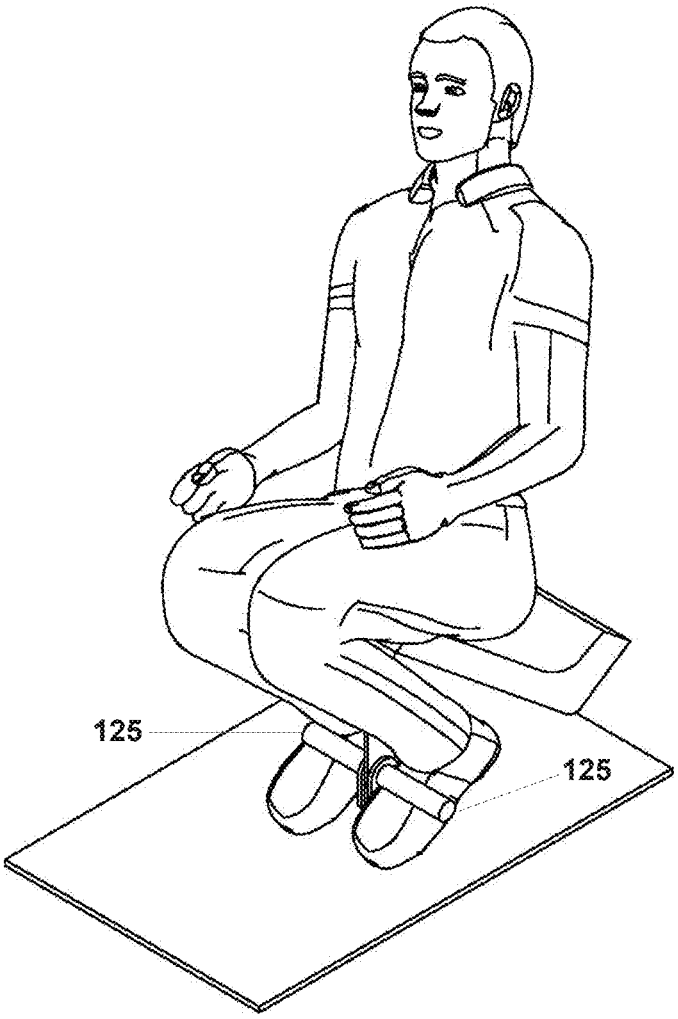
FIG. 5D shows a front perspective view of a user utilizing the configuration of FIG. 4A by leaning backwards.

FIG. 5D shows a front perspective view of the user 510 utilizing the configuration of FIG. 4A, which comprises foot supports 125, by leaning backwards. According to the presented configuration, the user inserts each foot under the respective foot support 125 thereby demonstrating one possible position.

Figure 5E:
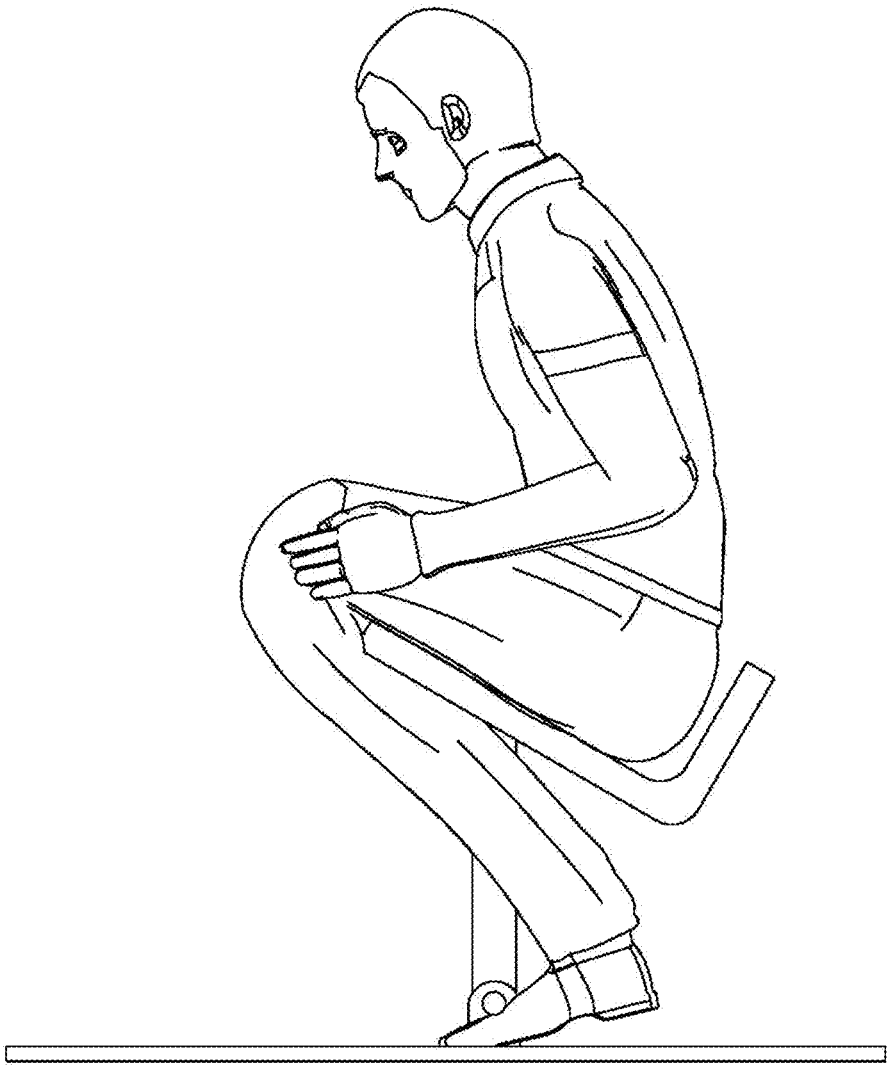
FIG. 5E shows a side view of a user demonstrating another position with the configuration of FIG. 4A.

FIG. 5E shows a side view of the user 510 demonstrating another position with the configuration of FIG. 4A.

According to embodiments of the present invention, the at least one leg support 130 may be detached from the leg shaft 120 and connected to another object, e.g., a table.

According to embodiments of the present invention, the leg shaft 120 may be detached from the base 110 and connected to another object, e.g., a table.

Figure 6A:
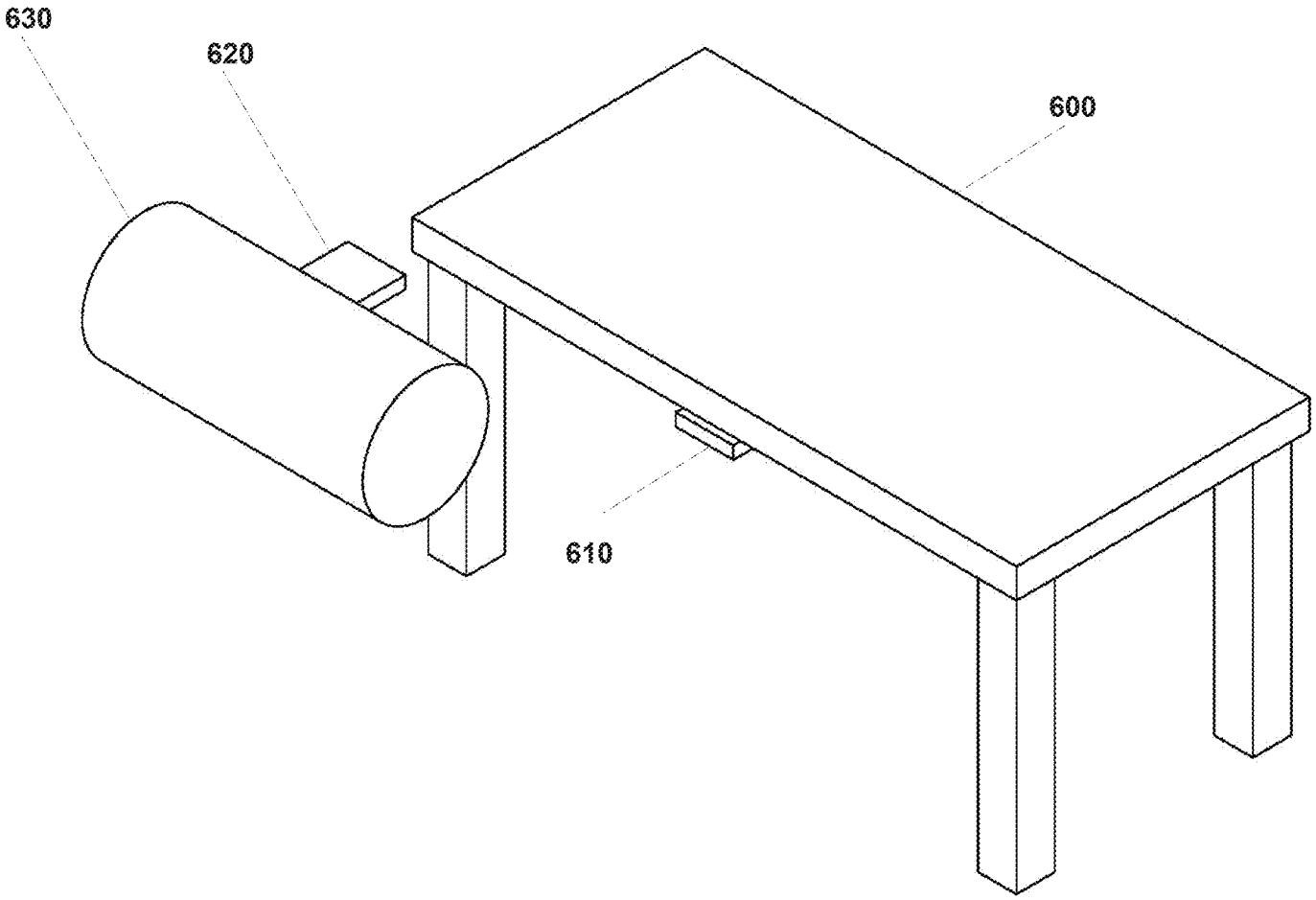
FIG. 6A shows another exemplary use of the leg support of the present invention.

FIG. 6A shows an exemplary use of at least one leg support 630. Table 600, which is shown as an exemplary object, comprises a connector 610, e.g., female connector, and the at least one leg support 630 comprises a connector 620, e.g., male connector. Thus, a user may connect the at least one leg support 630 to the table or workstation 600 and work in a plank stand position (e.g., to type on a keyboard), as an alternative to the conventional sitting or standing positions.

Alternatively, the leg shaft 120 may be detached from the base 110 along with the leg support 130 as one unit, and attached to the selected object, e.g., clamped.

Figure 6B:
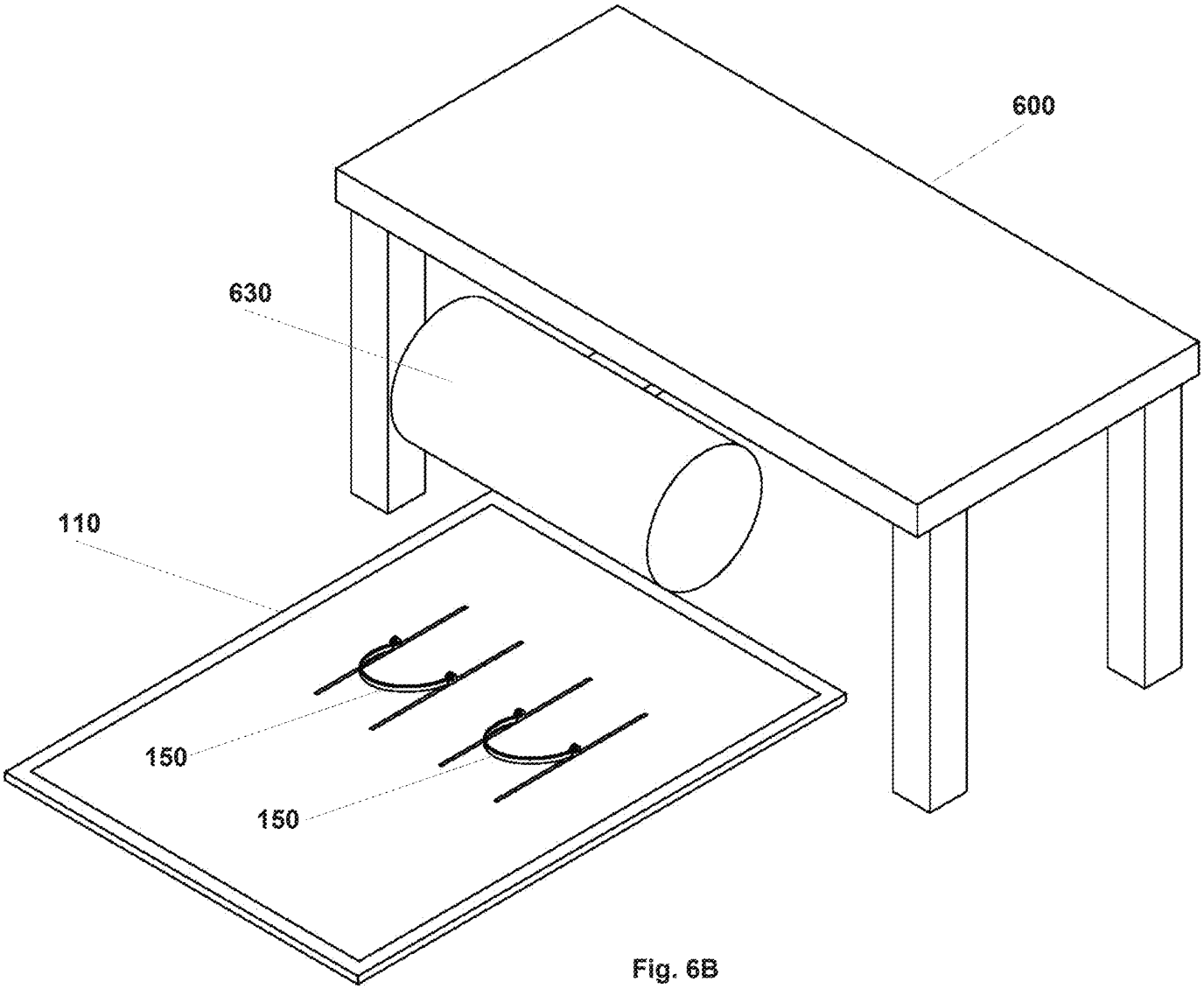
FIG. 6B shows the leg support of the present invention connected to a table and a base comprising the heel supports mounted in front of the leg support.

FIG. 6B shows the at least one leg support 630 connected to the table 600 and the base 110 comprising the heel supports 150 mounted in front of the leg support in order to facilitate utilizing and prevent slipping. As can be seen and understood, the leg shaft (not shown) may be detached from the base 110 or tilted to be essentially parallel to the base 110 surface.

Figure 6C:
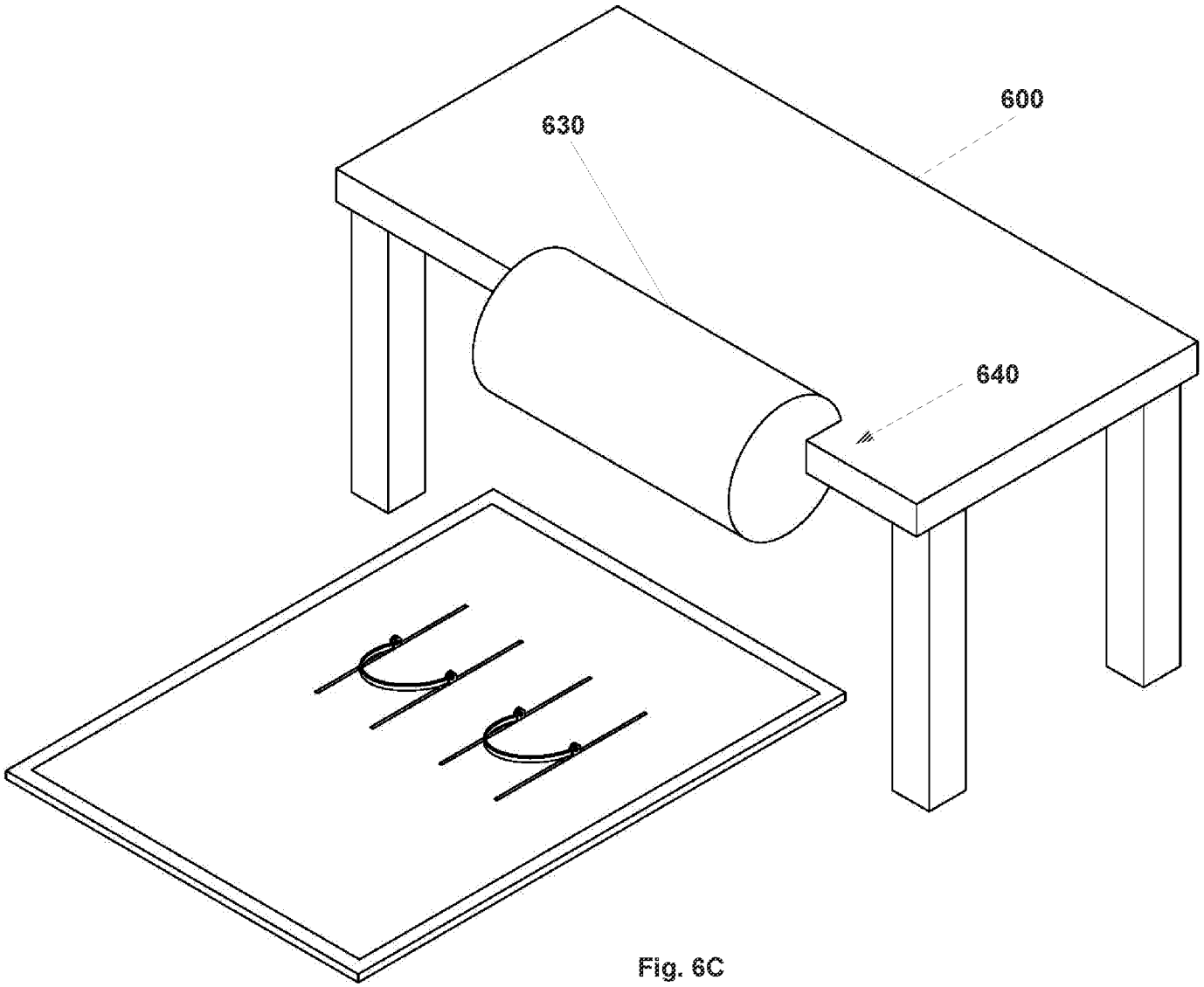
FIG. 6C shows another configuration in which the leg support of the present invention comprises a depression.

FIG. 6C shows another configuration in which the at least one leg support 630 comprises a depression 640 intended to receive the object to which the at least one leg support 630 is connected, e.g., table 600. According to embodiments of the present invention, the at least one leg support 630 may be attached to the object, e.g., clamped, or screwed.

Figure 6D:
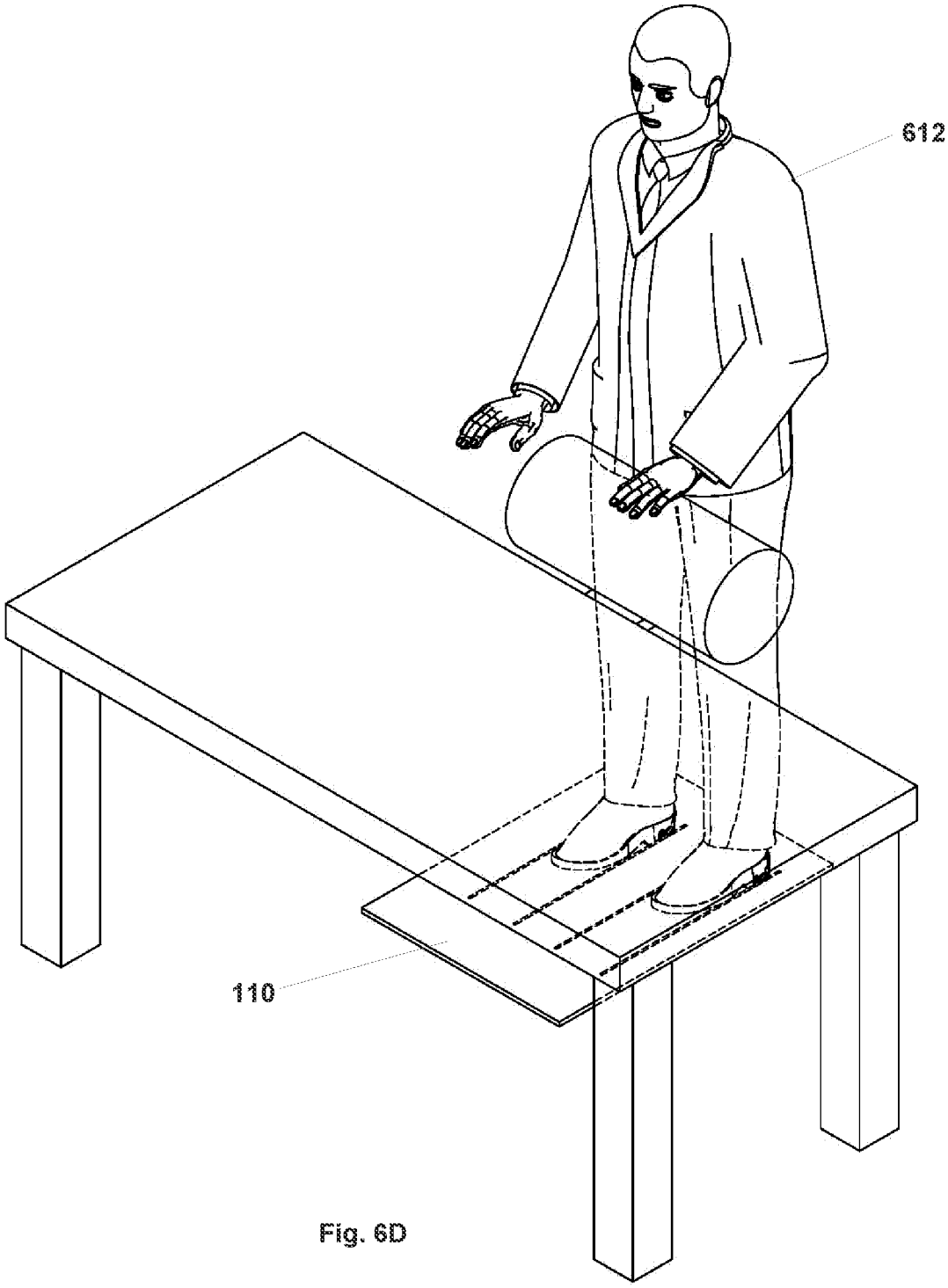
FIG. 6D shows an exemplary front perspective view of a user standing in an exemplary position using the configuration of FIG. 6B.

FIG. 6D shows an exemplary front perspective view of a user 612 standing on the base 110, in an exemplary position using the configuration of FIG. 6B.

Figure 6E:
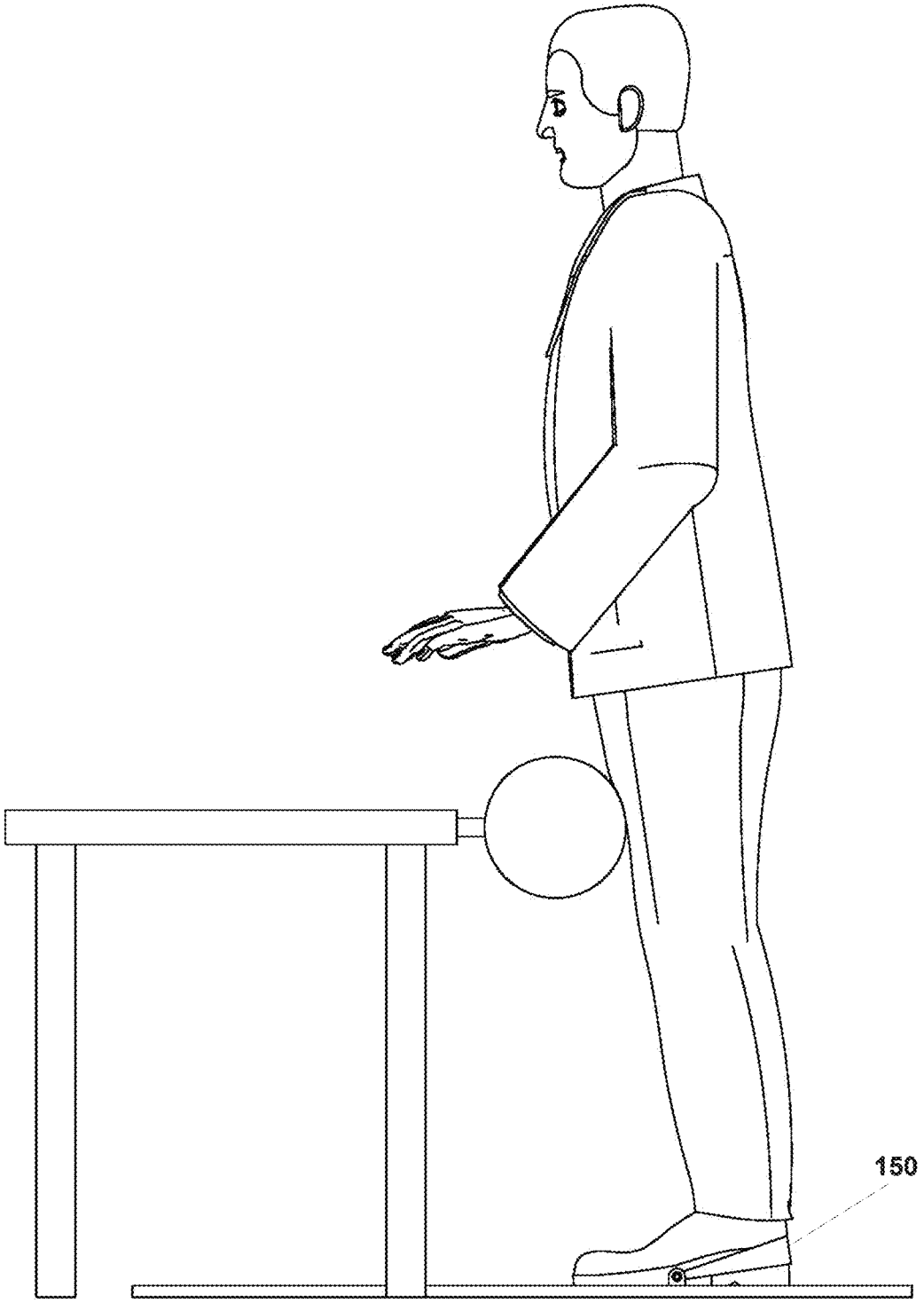
FIG. 6E shows a side view of FIG. 6D.

FIG. 6E shows a side view of FIG. 6D with the user in a slight angle of a forward inclination. As can be seen in this exemplary embodiment, the user 612 may use the heel supports 150 in order to prevent slipping.

It will be appreciated that the presented configuration does not necessarily have to include the heel supports 150. The user may be assisted by the anti-slip material which may cover at least part of the base 110 and/or with insertions into the base and/or using a base having a texture or a pattern, in order to prevent slipping. It will be appreciated that the configuration of FIG. 6B is not limited to include the plank stand of FIG. 1D and any one of the plank stands described above may be used.

According to embodiments of the present invention, the plank stand of FIG. 4A (with or without the foot supports 125 and/or heel supports 150) may be used with the at least one leg support 130 connected to another object, e.g., a table.

Figure 7A:
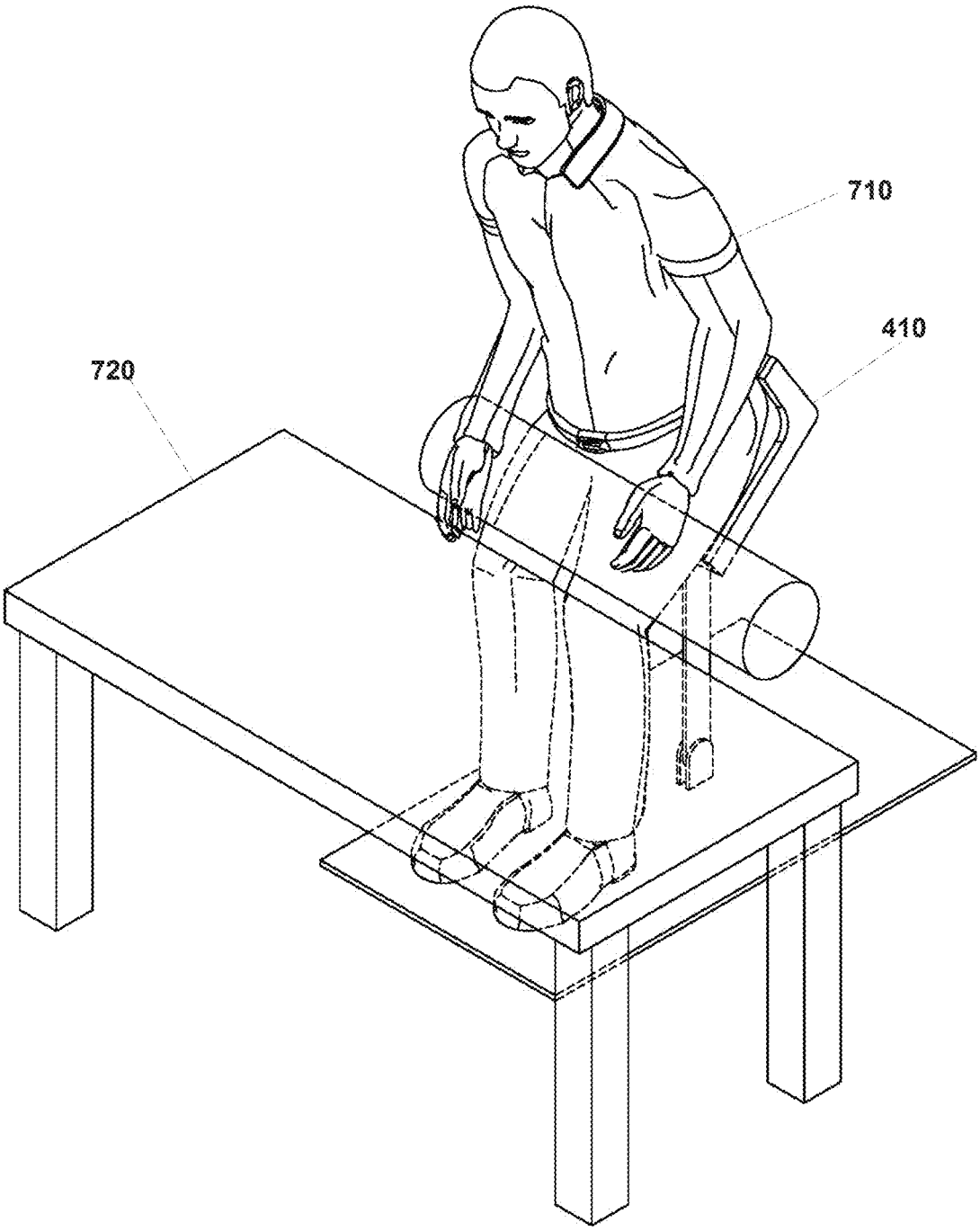
FIG. 7A shows an exemplary front perspective view of a user using the plank stand of FIG. 4A by resting part of his weight on the chair or resting part of his weight on the leg support connected to a table.

FIG. 7A shows an exemplary front perspective view of a user 710 using the plank stand of FIG. 4A by resting part of his weight on the chair 410 or resting part of his weight on the at least one leg support 730 connected to table 720, thereby alternating the shift of his weight between the two. This prevents being in one stationary position for any length of time. By making minor changes in the distribution of weight between the chair and the at least one leg support, the user is able to frequently and slightly engage different muscles while, at the same time, alleviating pressure on the spine and skeletal frame. It will be appreciated that there are two types of workstations; where the user sits on a chair before the table, or where the user stands before a heightened worktable. The configuration of FIG. 7A is a hybrid of the two where the user shifts from leaning back with their buttocks on the chair, or leaning forward on the at least one leg support.

Figure 7B:
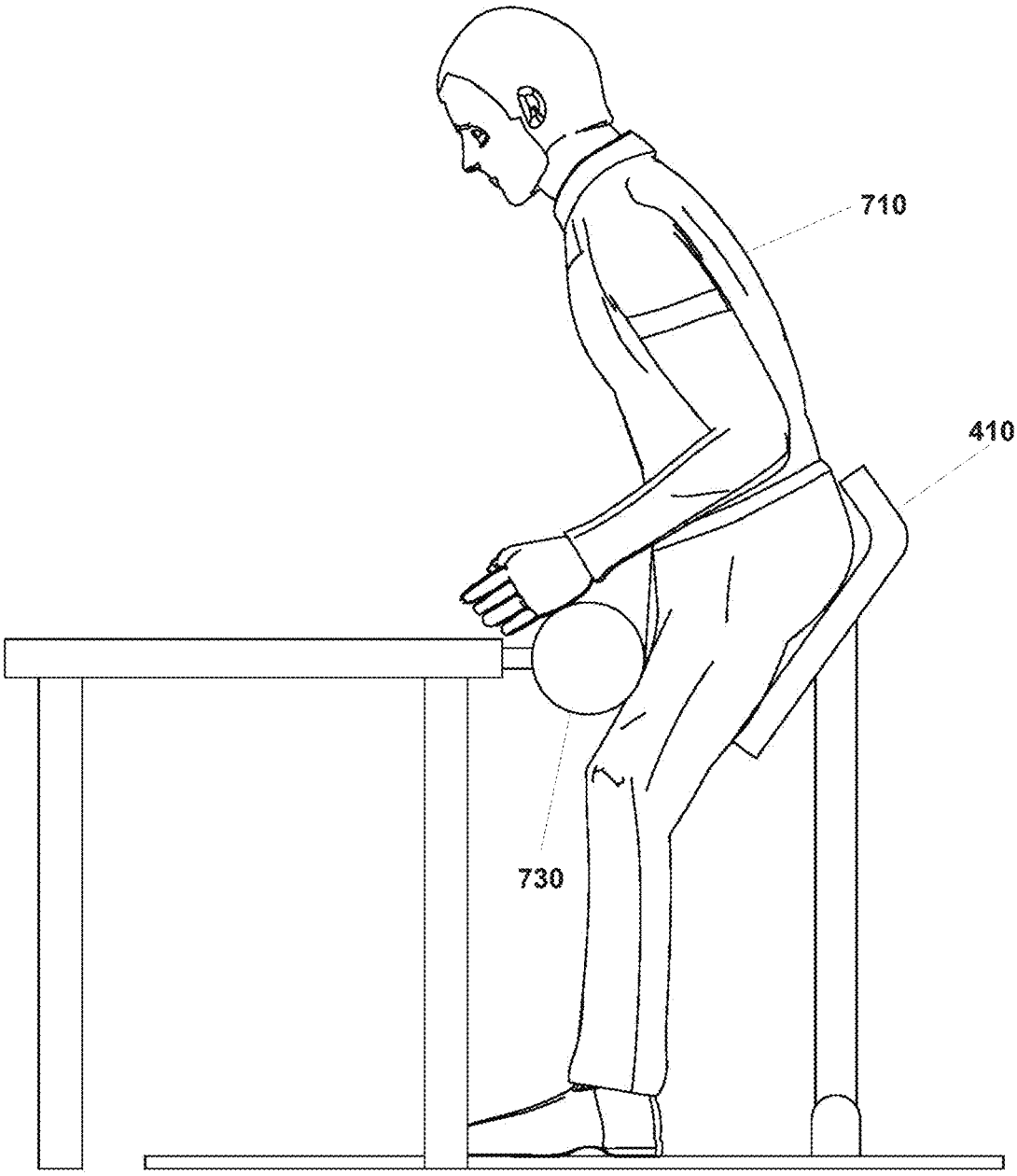
FIG. 7B shows a side view of FIG. 7A.

FIG. 7B shows a side view of FIG. 7A.

It will be appreciated that, according to embodiments of the present invention, instead of the chair 410, at least one leg support 630 may connected to leg shaft 120.

Figure 8:
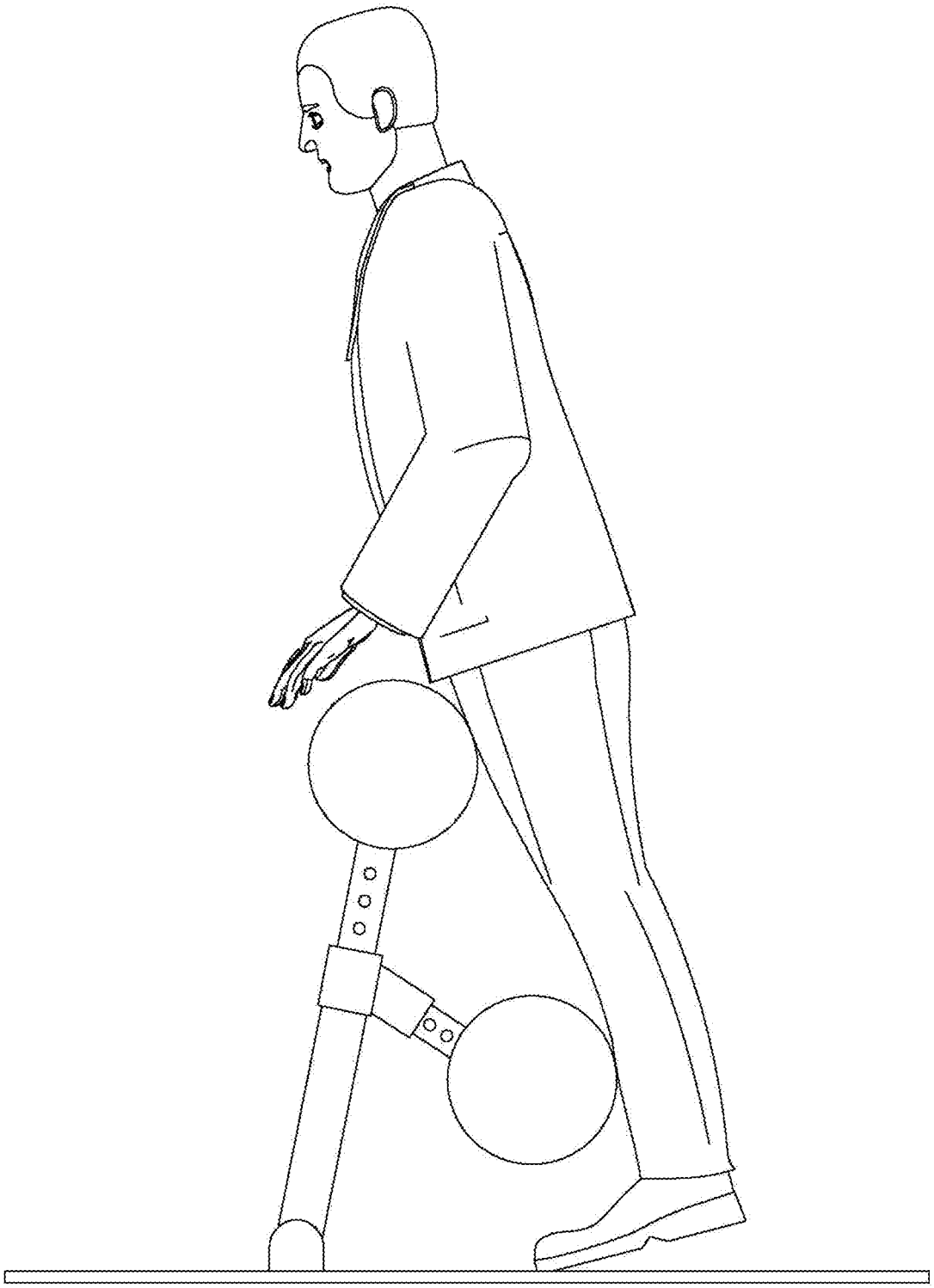
FIG. 8 shows a side view of an exemplary usage of the configuration of FIG. 1I.

FIG. 8 shows a side view of an exemplary usage of the configuration of FIG. 1I.

Figure 9A:
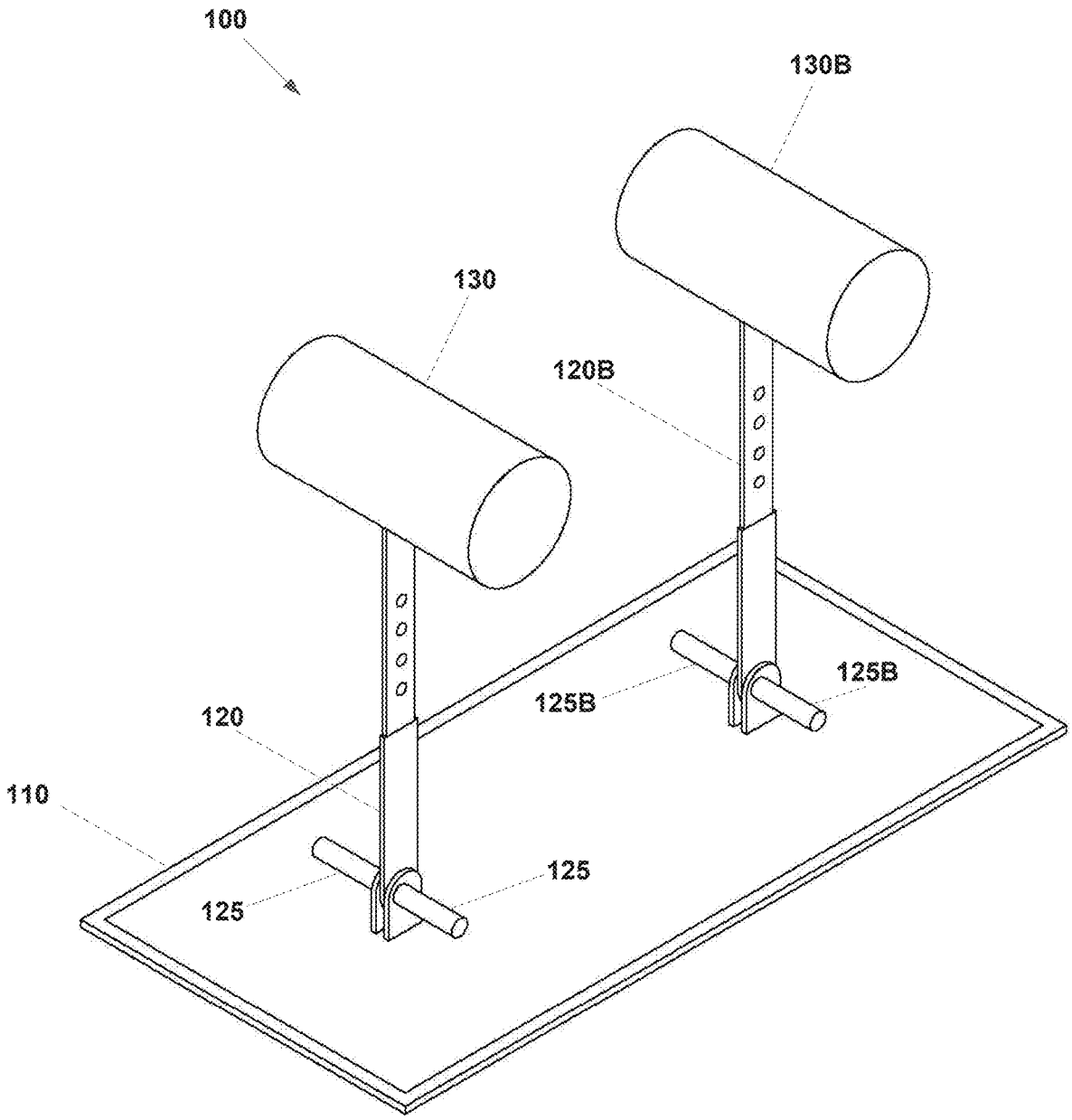
FIG. 9A shows another exemplary embodiment of the plank stand 100 of the present invention.

FIG. 9A shows another exemplary embodiment of the plank stand 100 of the present invention in which the plank stand 100 further comprises a leg shaft 120B, connected with the base 110, and at least one leg support 130B connected with the leg shaft 120B. It will be appreciated that the presented embodiment may also comprise any one of the additional features described and shown in conjunction with FIGS. 1B to 1M. For the purpose of demonstration, each leg shaft (120, 120B) is shown with two foot supports 125 and 125B, but it will be appreciated that the present embodiment is not limited to include foot supports 125 and/or 125B. According to embodiments of the present invention, the distance between the leg shaft 120 and 120B may be adjusted, for example, using a rail.

Figure 9B:
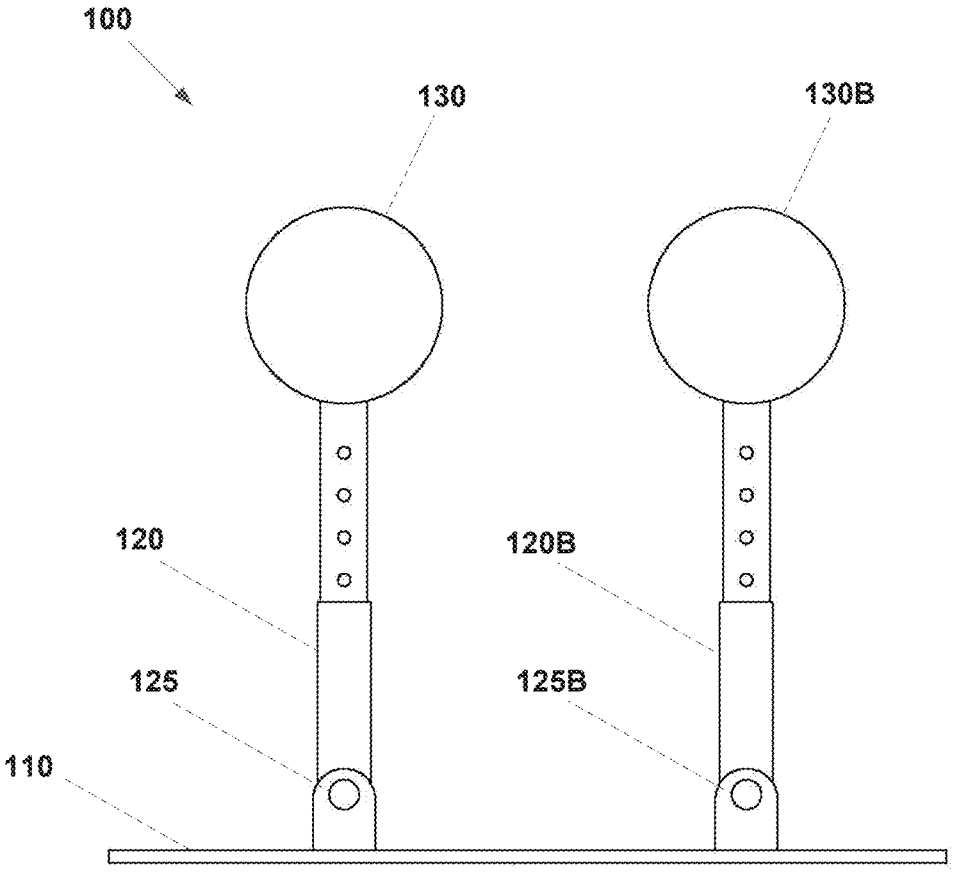
FIG. 9B shows a side view of the embodiment of FIG. 9A.

FIG. 9B shows a side view of the embodiment of FIG. 9A.

Figure 9C:
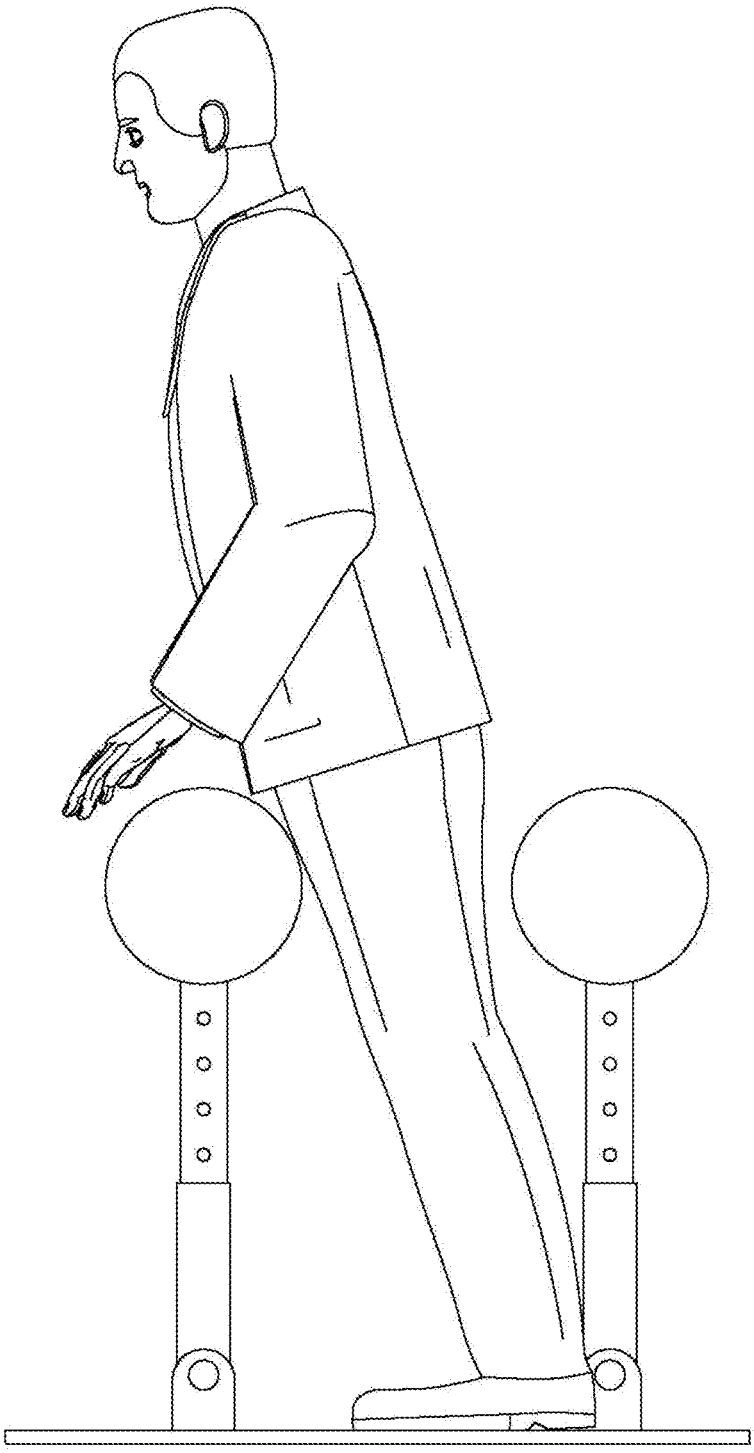
FIG. 9C shows a side view of a user utilizing the configuration of FIG. 9A.

FIG. 9C shows a side view of a user 910 utilizing the configuration of FIG. 9A, by leaning forward.

Figure 9D:
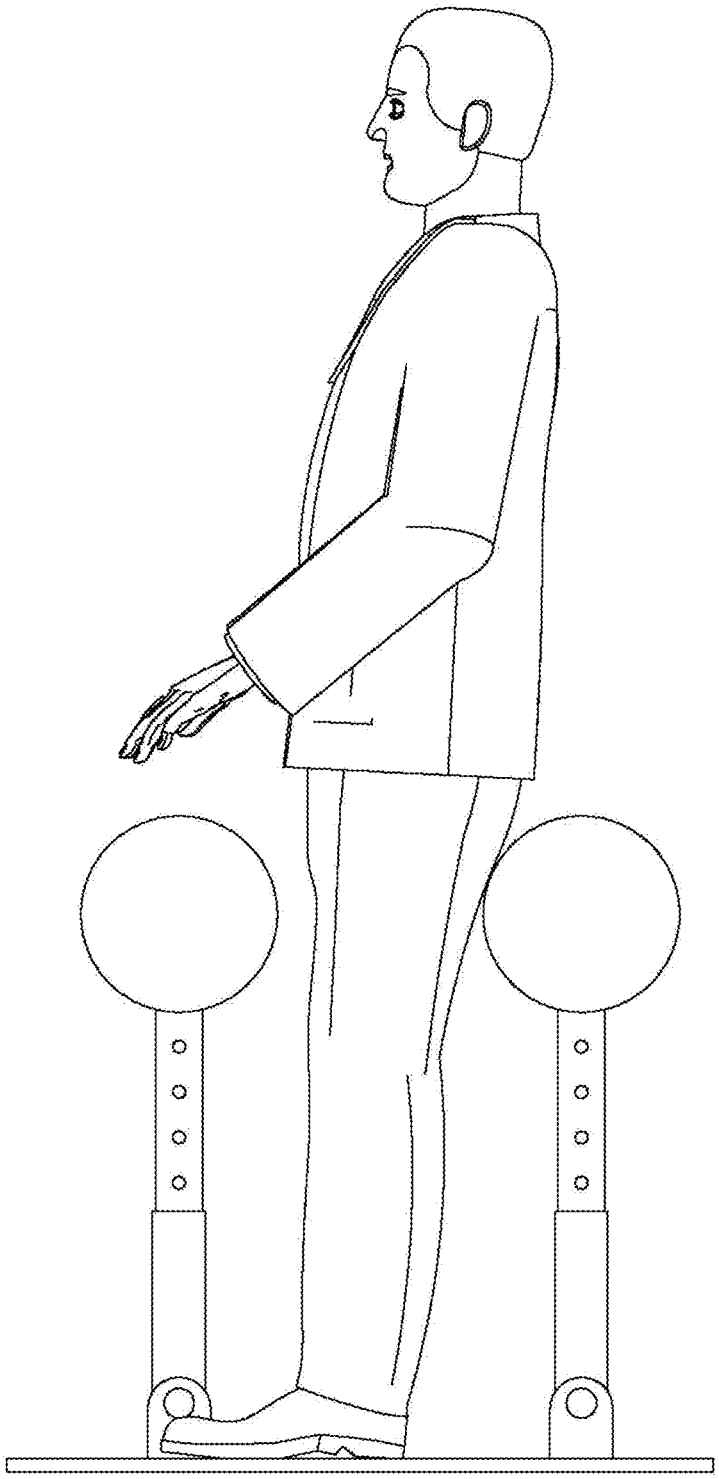
FIG. 9D shows another side view of a user utilizing the configuration of FIG. 9A.

FIG. 9D shows a side view of a user 910 utilizing the configuration of FIG. 9A, by leaning backward.

Figure 9E:
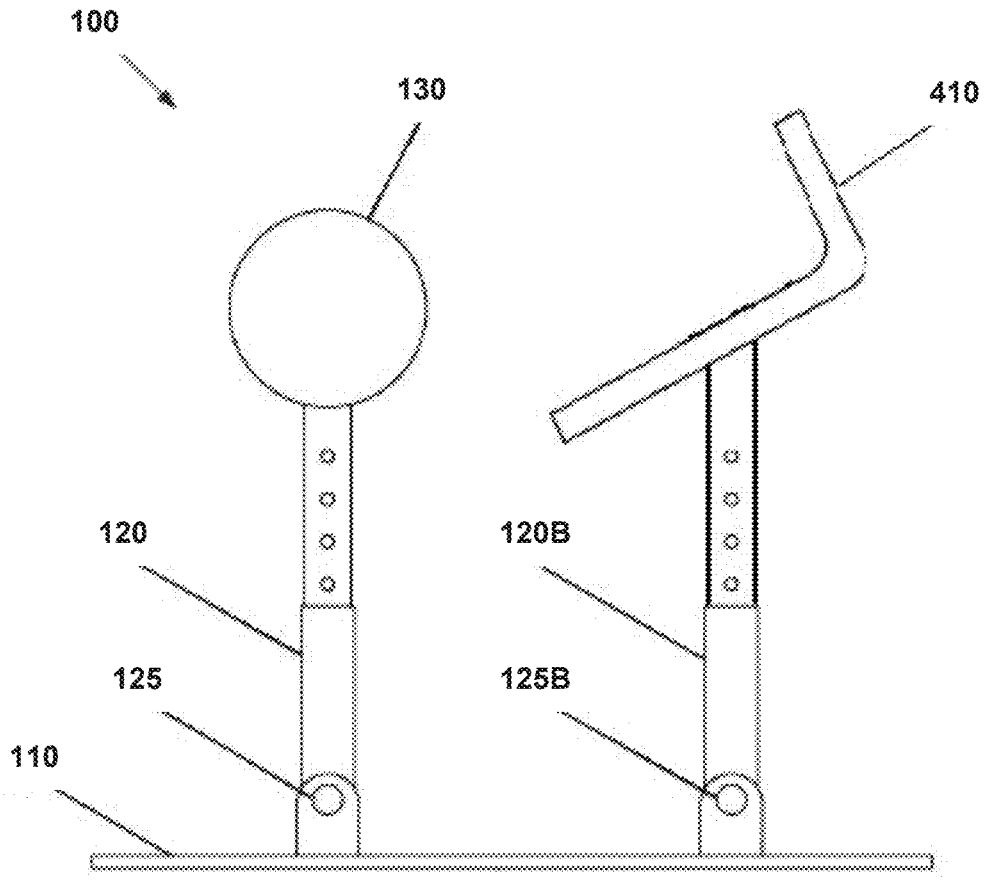
FIG. 9E shows another exemplary embodiment of the plank stand 100 of the present invention with a chair.

FIG. 9E shows another exemplary embodiment of the plank stand 100 of the present invention in which the plank stand 100 further comprises a leg shaft 120B, connected with the base 110, and a chair 410 connected with the leg shaft 120B. It will be appreciated that the presented embodiment may also comprise any one of the additional features described and shown in conjunction with FIGS. 1B to 1M. For the purpose of demonstration, each leg shaft (120, 120B) is shown with two foot supports 125 and 125B, but it will be appreciated that the present embodiment is not limited to include foot supports 125 and/or 125B. According to embodiments of the present invention, the distance between the leg shaft 120 and 120B may be adjusted, for example, using a rail.

It will be appreciated that the base 110 shape is not limited to the one shown and the base may have any shape enabling a user to stand on the base.

According to embodiments of the present invention, the base of all the embodiments described above may comprise at least one floor-angle element, e.g., one on each corner beneath the base, one on each rear corner beneath the base, one on the rear side of the base, etc. in order to enable adjustment of the base angle.

According to embodiments of the present invention, the at least one leg support 130 may comprise two leg supports, one connected to the left side of the leg shaft 120, and the other to the right side of the leg shaft 120. In such an embodiment, for example, two inner screws may enable to connect each leg support to the leg shaft 120, and adjust the height of the leg supports.

According to embodiments of the present invention, the plank stand 100 may further comprise a designated surface, connected to the leg shaft 120, which may serve as a workstation or a table for the user, a computer dock, a cup holder, left dock, right dock, etc.

According to embodiments of the present invention, the plank stand 100 may further comprise an integrated electric power outlet, communication outlet and the like.

According to embodiments of the present invention, the plank stand 100 may further comprise a swivel mechanism connected to the base 110 which enables the base to rotate.

According to embodiments of the present invention, the base 110 may have the shape of a wedge.

It will be appreciated that embodiments of the present invention are not limited to include two foot supports and/or two heel supports and may include at least one foot supports and/or at least one heel supports or none.

According to embodiments of the present invention, the at least one foot support described above may be connected to the base instead of to the leg shaft.

It will be appreciated by persons skilled in the art that the present invention is not limited to what has been particularly shown and described hereinabove. Rather, the scope of the present invention is defined by the appended claims and includes combinations and sub-combinations of the various features described hereinabove as well as variations and modifications thereof which would occur to persons skilled in the art upon reading the foregoing description.

The invention claimed is:

1. A plank stand, comprising:

a base;

a first leg shaft connected, on a first end thereof, with said base;

at least one first leg support connected with a second end of said first leg shaft;

a second leg shaft connected, on a first end thereof, with said base; and one of at least one second leg support or a chair, connected with a second end of said second leg shaft;

wherein said first and second leg shafts extend from said base a distance so that said leg supports are configured to be at a height to contact a user's lower body, from said user's thighs to said user's shins or calves, and wherein said plank stand is configured to enable a user to stand on said base, and lean forward such that said at least one first leg support is in contact with said user's lower body, from said user's thighs to said user's shins or calves, or one of:

lean backward such that said at least one second leg support is in contact with a back side of said user's lower body, from said user's thighs to said user's shins or calves, without turning; or lean backward such that a chair is in contact with the back side of said user's lower body, from said user's thighs to said user's shins or calves, without turning.

2. The plank stand of claim 1, further comprising one or two heel supports connected with said base.

3. The plank stand of claim 2, wherein at least one of said one or two heel supports comprises a U-shaped member connected with said base via two hinges.

4. The plank stand of claim 3, wherein at least one of said one or two heel supports comprises at least one wedge under said U-shaped member configured to keep said U-shaped member elevated.

5. The plank stand of claim 2, wherein said one or two heel supports are configured to be moved towards and away from said first leg shaft.

6. The plank stand of claim 2, wherein said one or two heel supports are configured to be fixated in a plurality of positions in respect to said first leg shaft.

7. The plank stand of claim 1, wherein said first leg shaft is movably connected, on said first end thereof, with said base.

8. The plank stand of claim 7, wherein said first leg shaft is configured to be fixated in a plurality of angles in respect to said base.

9. The plank stand of claim 1, further comprising at least one third leg support connected with said first leg shaft between said first end and said second end thereof.

10. The plank stand of claim 9, wherein said at least one third leg support is connected with said first leg shaft via at least one mechanism allowing at least one of: vertical, horizontal, and angular adjustment of said at least one third leg support in respect to said first leg shaft.

11. The plank stand of claim 1, wherein said first leg shaft is extendable.

12. The plank stand of claim 1, further comprising one or two foot supports connected with one of said first leg shaft and said base.

13. The plank stand of claim 1, wherein said base comprises at least one insert configured to receive at least one foot of a user.

14. The plank stand of claim 1, further comprising one or two foot supports connected with said second leg shaft.

15. The plank stand of claim 1, wherein an upper side of said base is one of: at least partially covered with an anti slip material, comprises an anti slip material, comprises a texture, and comprises a pattern.

16. The plank stand of claim 1, wherein said at least one first leg support comprises two leg supports, one connected to a left side of said first leg shaft, and the other to a right side of said first leg shaft.

17. The plank stand of claim 1, wherein said at least one first leg support is movably connected with said second end of said first leg shaft.

18. A plank stand, comprising:

a base;

a first leg shaft connected, on a first end thereof, with said base;

at least one first leg support movably connected with a second end of said first leg shaft;

a second leg shaft connected, on a first end thereof, with said base; and one of at least one second leg support or a chair, connected with a second end of said second leg shaft;

wherein said plank stand is configured to enable a user to stand on said base, and lean forward such that said at least one first leg support is in contact with said user's lower body, from said user's thighs to said user's shins or calves, or one of:

lean backward such that said at least one second leg support is in contact with a back side of said user's lower body, from said user's thighs to said user's shins or calves, without turning; or lean backward such that a chair is in contact with the back side of said user's lower body, from said user's thighs to said user's shins or calves, without turning.

* * * * *